US007435374B2

(12) United States Patent
Kimura et al.

(10) Patent No.: US 7,435,374 B2
(45) Date of Patent: Oct. 14, 2008

(54) SURFACE TREATMENT FACILITY OF METAL PLATE AND METHOD FOR PRODUCING METAL PLATE

(75) Inventors: Yukio Kimura, Tokyo (JP); Masayasu Ueno, Tokyo (JP); Yasuhiro Sodani, Tokyo (JP); Shogo Tomita, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 579 days.

(21) Appl. No.: 10/505,992

(22) PCT Filed: Aug. 2, 2002

(86) PCT No.: PCT/JP02/07895

§ 371 (c)(1),
(2), (4) Date: Oct. 7, 2004

(87) PCT Pub. No.: WO03/074230

PCT Pub. Date: Sep. 12, 2003

(65) Prior Publication Data

US 2005/0116397 A1 Jun. 2, 2005

(30) Foreign Application Priority Data

Mar. 4, 2002 (JP) ..... 2002-056860
Mar. 4, 2002 (JP) ..... 2002-056861
Apr. 16, 2002 (JP) ..... 2002-113501

(51) Int. Cl.
*C21D 1/74* (2006.01)

(52) U.S. Cl. ..... 266/135; 266/114

(58) Field of Classification Search ..... 266/135, 266/114

See application file for complete search history.

(56) References Cited

U.S. PATENT DOCUMENTS 3,984,943 A 10/1976 Kono et al.
5,554,235 A 9/1996 Noe et al.
6,797,411 B2 * 9/2004 Sodani et al. ..... 428/659

FOREIGN PATENT DOCUMENTS

EP 0 712 187 A2 5/1996
GB 291670 A 6/1928
JP 4-256578 A 9/1992
JP 6-31634 A 2/1994

(Continued)

OTHER PUBLICATIONS

The Making, Shaping and Treating of Steel, 10th edition pp. 1083-1096, Dec. 1989.*

(Continued)

*Primary Examiner*—Scott Kastler
(74) *Attorney, Agent, or Firm*—Frishauf, Holtz, Goodman, & Chick, P.cC

(57) ABSTRACT

A surface treatment apparatus for a metal sheet has a blasting device for blasting solid particles having an average particle diameter of 300 μm or less onto the metal sheet which is continuously transferred, a blast chamber in which the blasting device is disposed, and cleaning means provided at the downstream side of the blast chamber for cleaning a surface of the metal sheet. At an inlet side of the blasting device, a deposits removing device for removing deposits on the surface of the metal sheet may be provided.

16 Claims, 26 Drawing Sheets

FOREIGN PATENT DOCUMENTS

| | | | |
|---|---|---|---|
| JP | 8-281556 | A | 10/1996 |
| JP | 8-309662 | A | 11/1996 |
| JP | 9-1460 | A | 1/1997 |
| JP | 9-155743 | A | 6/1997 |
| WO | WO 01/60568 | A1 | 8/2001 |

OTHER PUBLICATIONS

Patent Abstracts of Japan, vol. 1997, No. 05, May 30, 1997 of JP 9-1460 (ITO KIKO KK), Jan. 7, 1997.

* cited by examiner

SURFACE TREATMENT FACILITY OF METAL PLATE AND METHOD FOR PRODUCING METAL PLATE

This application is the United States national phase application of International Application PCT/JP02/07895 filed Aug. 2, 2002.

FIELD OF THE INVENTION

The present invention relates to an apparatus for performing surface treatment of a metal sheet and a method for producing a metal sheet using this apparatus, the surface treatment including adjustment of surface roughness of the metal sheet by blasting fine solid particles onto a surface of the metal sheet such as a steel sheet.

DESCRIPTION OF THE RELATED ARTS

As for thin steel sheets processed by press forming, such as zinc-plated steel sheets and cold-rolled steel sheets, it has been believed that the surface roughness of a metal sheet must be appropriately adjusted. The reason for this is that by forming a predetermined surface roughness on a metal-sheet, oil-retainability between the metal sheet and a mold used in press forming are improved so as to prevent troubles such as mold galling and breakage of metal sheets.

In general, in order to adjust the surface roughness of a metal sheet, a method has be used which is performed by the steps of forming predetermined microscopic roughness on the surface of a rolling roll, and transferring the roughness in temper rolling. However, in the method for transferring the surface roughness of the roll in temper rolling, dense roughness cannot be formed, and in addition, due to the change in roll roughness with time caused by roll abrasion or the like, problems have occurred such that the surface roughness of a metal sheet is changed.

As a method different from the conventional one performed by temper rolling, the inventors of the present invention found a method for adjusting the surface roughness by directly blasting fine solid particles onto a surface of a metal sheet such as a zinc-plated steel sheet. According to this method, when spherical solid particles are made to collide against the surface of a metal sheet, a great number of microscopic concave portions are formed, and so-called dimple-shaped microscopic roughness are formed.

The surface structure on which the dimple-shaped microscopic roughness are formed as described above has a superior effect of particularly improving oil-retainability in a gap formed between a metal sheet and a mold used in press forming, and as a result, the press formability can be significantly improved. In addition, since dense roughness with smaller pitches are formed on the surface of a metal sheet as the particle diameters of solid particles to be blasted are decreased, the image clarity after painting is also improved, and as a result, metal sheets can be obtained which are suitably used, for example, for application of outer plates of automobiles.

As means for blasting solid particles, for example, a centrifugal rotor blasting device or a pneumatic blasting device may be typically mentioned. In the pneumatic blasting device, compressed air is accelerated by a jet nozzle, and by using the drag of the air, solid particles are accelerated. On the other hand, in the centrifugal rotor type blasting device, solid particles are blasted using a centrifugal force generated by rotating vanes, and since a relatively large blast amount can be obtained as compared to that of the pneumatic blasting device, a metal sheet having a large width is suitably processed at a high speed.

In a steel producing line for a zinc-plated steel sheet or a cold-rolled steel sheet, when solid particles are blasted onto a surface of the metal sheet, the metal sheet which is fed at a high speed must be treated for a short period of time, and hence a large amount of solid particles must be blasted in a short period of time.

In this case, after being made to collide against the metal sheet, the solid particles thus blasted are once recovered, followed by classification treatment or the like, and in general, the particles are circulated for reuse. In addition, the blasting device is provided in a blast chamber so that the solid particles thus blasted are not dispersed to the periphery.

As described above, in techniques for forming the surface roughness by blasting fine sold particles, in general, the solid particles are blasted in a blast chamber so as not to be dispersed to the periphery. However, when the sold particles are blasted onto a metal sheet which is continuously fed, an outlet portion of the blast chamber cannot be totally sealed, and a predetermined opening must be provided therein. When the sealing of the outlet is tightly performed, a sealing portion may be directly brought into contact whit the metal sheet to generate scratches on the surface thereof, or particles remaining on the metal sheet are pressed into the surface of the metal sheet, and as a result, surface defects may occurs with a high probability. In particular, since a metal sheet which is transferred at a high speed is being vibrating in a predetermined manner in accordance with the increase and decrease in line speed, scratches are liable to be formed on the surface of the metal sheet in many cases.

Accordingly, through the opening of the outlet of the blast chamber, a predetermined amount of solid particles is carried out from the blast chamber. Since the solid particles carried out from the blast chamber cannot be recovered and circulated for reuse, the amount of solid particles in a circulation system is decreased with time, and as a result, the solid particles must be appropriately replenished. The situation described above causes the decrease in yield of the solid particles, resulting in increase in producing cost for forming the surface roughness on the metal sheet.

In addition, the solid particles carried out from the blast chamber through the opening of the outlet may again fall onto the metal sheet so as to be brought into contact with various rolls disposed in a production line or so as to adhere onto the rolls, and as a result, abrasive scratches may be formed on the surface of the metal sheet by the solid particles in some cases. In addition, when the solid particles are buried in the surface of the metal surface, a problem in that the cleanness of the metal sheet is degraded may arise in some cases.

In addition, measures may be considered in that means for blowing off the solid particles in the direction toward the upstream side of the blast chamber is provided by disposing an air purge or the like in the blast chamber at a position close to the outlet thereof so that the solid particles are prevented from being carried out from the blast chamber through the opening of the outlet.

However, since very fine particles having an average particle diameter of 300 μn or less are used as solid particles suitable for forming the surface roughness, the particles blown off by the air purge interfere with the flow of the particles blasted by the blasting device, and as a result, a problem may arise in that the formation of the surface roughness on the metal sheet is interfered with. That is, the solid particles blown off by the air purge toward the upstream side of the blast chamber are dispersed directly between the blasting device and the metal sheet and are made to collide against the particles blasted from the blasting device, thereby decreasing the speed of the blasted particles. In addition to the direct interference with the blasted particles caused by the air purge, the particles may be reflected inside the blast chamber so as to interfere with the blast of the solid particles by the blasting device or may fall and deposit on the metal sheet at the upstream side with respect to the blasting device to form a type of protective layer, and as a result, the formation of the surface roughness by blasting may be disadvantageously interfered with in some cases.

In addition, the flow generated by reflection or the like of the solid particles blasted from the blasting device and the flow of the solid particles blown off by the air purge are combined together and interfere with each other, thereby generating complicated movement of the solid particles in the blast chamber. Hence, the behavior of the solid particles in the blast chamber is difficult to estimate. In addition, also in the case in which a suction device is provided which sucks the solid particles from the inside of the blast chamber, it is difficult to estimate an effective disposition and capacity of the suction device.

The problems as described above are the phenomena caused by the fact that the solid particles thus blasted are all fine particles, and the reason for this is that since the solid particles are likely to be blown off by the air purge and to float in the blast chamber, the flow of the floating particles is difficult to control. Hence, a technique for removing relatively large solid particles from a steel sheet is not effectively applied to an apparatus for adjusting the surface roughness, the relatively large solid particles being used, for example, for a shot blast method for descaling a steel sheet.

For example, in Japanese Unexamined Patent Application Publication No. 4-256578, a technique has been disclosed in which when an oxide layer on a steel surface generated by hot rolling or the like is removed by blasting solid particles used as an abrasive sweeping agent, shot particles remaining on the steel sheet are blown off using a scraper and a gas jet nozzle.

However, an apparatus of the technique disclosed in Japanese Unexamined Patent Application Publication No. 4-256578 is to perform descaling, and hence, in order to increase a collision force (a kinetic energy of a solid particle) against the surface of the steel sheet, the enhancement of an abrasive sweeping effect is generally attempted by using relatively large sold particles having a size of approximately 500 μm to 2 mm. Accordingly, even when blown off by using a gas jet nozzle, the solid particles are not allowed to float and to remain.

On the other hand, in the case in which fine solid particles are blasted in order to adjust the surface roughness of a metal sheet, when the particles are simply blown off by a gas jet nozzle, most of the solid particles are vigorously blown off into the air, thereby interfering with the formation of the surface roughness or escaping outside the blast chamber through a gap at the outlet. Hence, the technique described above cannot be applied in order to solve the above problems.

In addition, when being allowed to deposit on a steel sheet, the solid particles cover the surface thereof as a protective layer, and as a result, even when the solid particles are blasted, dents cannot be effectively formed on the surface of the steel sheet. In addition, when the solid particles deposit partly on the surface, the surface roughness varies from place to place to produce an uneven appearance, and as a result, the quality is degraded.

SUMMARY OF THE INVENTION

It is an object of the present invention to provide a surface treatment apparatus for a metal sheet, which is able to manufacture a metal sheet having superior cleanness of the surface thereof and superior appearance, and to provided a method for producing a metal sheet using the apparatus described above.

To attain the object, the present invention provides the following surface treatment apparatus for a metal sheet.

[1] A surface treatment apparatus for a metal sheet, comprises:

a blasting device for blasting solid particles having an average particle diameter of 300 μm or less onto the metal sheet which is continuously transferred;

a blast chamber in which the blasting device is disposed; and cleaning means for cleaning a surface of the metal sheet, said cleaning means being provided at the downstream side of the blast chamber.

As the metal sheet described above, a cold-rolled steel sheet or a surface-treated steel sheet is primarily used. In the cold-rolled steel sheet, in addition to ordinary steel, special steel, such as high-carbon steel, an electromagnetic steel sheet, or Invar, is included. In addition, as the surface-treated steel sheet, various surface-treated steel sheets processed by surface treatment by means of hot-dip galvanizing, electrolytic plating, and the like are included, and a zinc-plated steel sheet is primarily used. The reasons for this are that the press formability and the image clarity after painting are required in many cases, and that as the surface roughness of a steel sheet (microscopic concave and convex structure of the surface), a dense and uniform structure is required. Hence, the case in which descaling is performed for a hot-rolled steel sheet by blasting solid particles is out of the scope of the present invention. As described above, although primarily applied to steel sheets such as a cold-rolled steel sheet and surface-treated steel sheet, the present invention may also be applied to other metal sheets such as an aluminum sheet, an aluminum alloy sheet, a titanium sheet, and a titanium alloy sheet, and hence all types of metal sheets may also be used in the present invention.

General cold-rolled steel sheets, surface-treated steel sheets, and the like are manufactured in the form of a coil. Unlike the case of shot blast in which steel strips are individually charged in a blast chamber and are processed by batch treatment, the steel sheet described above must be processed to form the surface roughness thereon while being continuously transferred.

The reason the solid particles having an average particle diameter of 300 μm or less are blasted onto the surface of the metal sheet as described above is to densely form roughness with small pitches on the surface of the metal sheet. That is, by blasting the solid particles onto the surface of the metal sheet, the kinetic energy thereof is converted into press work onto the surface of the metal sheet, thereby forming dents (concaves) on the surface of the metal sheet. In this step, the size of the dent is decreased as the particle diameter of the solid particle is decreased, and hence minute concave portions are to be formed.

That is, by blasting a large amount of solid particles, a great number of minute dents are formed on the surface of the metal sheet, and denser microscopic roughness are formed, that is, dents with small pitches therebetween are formed. Since a great number of concaves, so-called dimple-shaped structures, per unit area are formed on the surface, the oil-retainability between a mold and the metal sheet can be improved in press forming and the like, and hence the press formability can be significantly improved.

When the average particle diameter of the solid particles is more than 300 μm, since microscopic roughness with small pitches cannot be formed, the improvement in press formability cannot be expected, and in addition, since long-period roughness on the surface of the metal sheet, that is, undulations, become large, the appearance is degraded and the image clarity after painting is also degraded. From the points described above, when the surface roughness is formed on the surface of a cold-rolled steel sheet or a surface-treated steel sheet, the average particle diameter of the solid particles must be set to 300 μm or less and preferably set in the range of from approximately 50 to 150 μm.

As means for blasting the solid particles, a centrifugal rotor type blasting device or a pneumatic blasting device may be used as described above. However, when a steel sheet having a large width is continuously processed at a high speed, a centrifugal rotor type blasting device which can increase the blast amount is advantageously used.

The blasting of the solid particles is performed in the blast chamber. The blast chamber is a region defined by a predetermined space, in which the solid particles are blasted and are made to collide against the surface of the metal sheet, and the blast chamber is used for preventing the blasted particles from being dispersed outside. In addition, a motor portion of the centrifugal rotor type blasting device is not always necessary to be disposed inside the blast chamber, and it may be enough when a portion for blasting the solid particles is disposed inside the blast chamber. In addition, in order to recover the blasted solid particles, a lower portion of the blast chamber is generally formed into a hopper shape having an angle equal to or more than the repose angle.

Although the blast chamber is not always necessary to be a closed space, the periphery of the chamber must be covered so as to prevent the solid particles from being dispersed outside and from being carried out. However, since the blast chamber has an inlet portion through which the metal sheet is continuously transferred and an outlet portion through which the metal sheet blasted with the solid particles is carried out, opening are formed at the positions described above.

[2] In the surface treatment apparatus for a metal sheet, described in [1], the cleaning means comprises at least one cleaner chamber.

The cleaning means preferably comprises at least one cleaner chamber. The cleaner chamber is disposed at the outlet side of the blast chamber and is partitioned therefrom. The cleaner chamber is a predetermined space in which solid particles which deposit on the metal sheet continuously transferred and solid particles carried out from the blast chamber through the outlet portion thereof are removed.

Since the cleaner chamber partitioned from the blast chamber is disposed at the outlet side thereof, even when gas jet devices are disposed in the cleaner chamber so as to blow off the solid particles which deposit on the metal sheet, the flow of the solid particles does not interfere with the particles blasted by the blasting device. In addition, since the following case will not occur in which the flow of the particles blasted by the blasting devices and the flow of the solid particles by the gas jet device are combined with each other and interfere with each other to produce a complicated flow, the flow of the solid particles in the cleaner chamber can be controlled to a certain extent, and for example, effective arrangement of the gas jet devices can be performed.

In addition, since the cleaner chamber is disposed, the amount of the solid particles, which deposit on the metal sheet and which are then carried out from the cleaner chamber through the outlet portion thereof, can be decreased by using the following property. That is, when intentionally allowed to float in the air by gas jetting or the like, the solid particles are unlikely to fall onto the metal sheet. On the other hand, in the case in which the gas jet devices are provided in the blast chamber, when a large amount of the solid particles is allowed to float, solid particles floating between the blasting device and the metal sheet interfere with effective formation of the surface roughness, and hence the removing method as described above cannot be used.

That is, in this surface treatment apparatus, since the cleaner chamber partitioned from the blast chamber is disposed, the solid particles which deposit on the metal sheet are effectively removed in the cleaner chamber having a function different from that of the blast chamber, that is, in a different space from that of the blast chamber, and as a result, the flow of the solid particles blasted onto the surface of the metal sheet in the blast chamber is not interfered with.

In the present invention, the partition between the blast chamber and the cleaner chamber means that the flow of the solid particles blasted from the blasting device onto the surface of the metal sheet in the blast chamber is separated from the behavior of the solid particles by the gas jet devices or the like in the cleaner chamber so as not to be interfered therewith. In particular, for example, an area at the connecting portion between the outlet of the blast chamber and an inlet of the cleaner chamber is formed smaller than that of a cross-sectional area of the blast chamber or the cleaner chamber, or a rubber or a cloth is hung on the outlet portion of the blast chamber. In addition, beside those described above, the pressure inside the cleaner chamber may be evacuated lower than that in the blast chamber so that solid particles in the cleaner chamber do not flow back to the blast chamber.

[3] In the surface treatment apparatus for a metal sheet, described in [2], the cleaner chambers are continuously disposed and have structures partitioned from each other.

It is preferable that the cleaner chambers be continuously disposed and have structures partitioned from each other. That is, a cleaner chamber is further disposed at the downstream side of the cleaner chamber disposed at the outlet side of the blast chamber, and a connecting portion between the cleaner chambers is partitioned from each other. As means for partitioning the cleaner chambers from each other, the above means for partitioning the cleaner chamber from the blast chamber may also be used. When the cleaner chambers are disposed and are partitioned from each other, a cleaner chamber located at a more downstream side can further decrease the remaining amount of solid particles, and as a result, the concentration of solid particles floating in the cleaner chamber located at the more downstream side can be decreased. Accordingly, the amount of the solid particles carried outside the cleaner chamber through the opening of the outlet can be further decreased.

[4] In the surface treatment apparatus for a metal sheet, described in [2] or [3], at least one cleaner chamber comprises a suction device for sucking solid particles.

Solid particles blown up by gas jetting in the cleaner chamber are allowed to float therein and are unlikely to again fall onto the metal sheet. In particular, when the volume of the clean chamber is increased, since the solid particles are allowed to float for a longer period of time, the case in which the solid particles fall onto the metal sheet and are then carried out from the cleaner chamber through the outlet thereof is not likely to occur. However, since the increase in volume of the cleaner chamber is restricted in view of an apparatus installation space, the increase described above may not be practical in some cases. Hence, when the suction device such as a suction blower for sucking the solid particles floating in the cleaner chamber is provided, although the volume of the cleaner chamber is relatively small, the amount of the solid particles which fall onto the metal sheet can be decreased, and the amount of the solid particles carried out from the cleaner chamber can be decreased.

[5] In the surface treatment apparatus for a metal sheet, described in any one of [2] to [4], at least one cleaner chamber has an upper portion height of 500 mm or more at a position closest to the metal sheet.

When the cleaner chamber has a predetermined volume, the solid particles are allowed to float, and hence the amount of solid particles which fall onto the metal sheet and are carried outside the system can be decreased. However, even when the volume of the cleaner chamber is large, due to the shape of the cleaner chamber, the solid particles which are allowed to float become liable to fall in some cases. For example, in the case in which the upper portion height of the cleaner chamber must be partly decreased by some reasons, when the solid particles pass through a portion at a small distance from the metal sheet, collision between the particles and an inside wall of the cleaner chamber occurs, and as a result, the particles may be liable to fall onto the metal sheet in some cases. However, when the cleaner chamber has a high ceiling portion, solid particles about to fall are again allowed to float with an air flow. Accordingly, in this surface treatment apparatus, the cleaner chamber is formed so that the height of the upper portion thereof from the metal sheet is at least 500 mm even at a position closest thereto.

When the height is less than 500 mm, solid particles floating by gas jetting become difficult to keep floating and are liable to fall onto the metal sheet. In particular, when the blast amount in the blast chamber is approximately 100 kg/min, the longest distance between the upper portion of the cleaner chamber and the metal sheet may be approximately 500 mm. However, when the blast amount in the blast chamber is larger than that described above, the height of the cleaner chamber must be increased. The reason for this is that a larger amount of the solid particles is allowed to float for a longer period of time.

[6] In the surface treatment apparatus for a metal sheet, described in any one of [2] to [5], at least one cleaner chamber has an outlet portion having a structure in which the space between an upper portion of the cleaner chamber and the metal sheet is decreased.

As described above, a large height of the cleaner chamber is advantageous to allow the solid particles to float, and the distance between the upper portion inside the cleaner chamber and the metal sheet is preferably set to at least 500 mm at a closest position therebetween. However, in this means, only at the outlet portion of the cleaner chamber, the space between the upper portion of the cleaner chamber and the metal sheet is decreased. The height at this portion may be less than 500 mm, and a small height is rather preferable.

At the outlet portion of the cleaner chamber, an opening must be provided through which the metal sheet is carried out; however, most of the solid particles carried outside escape through this opening. The escape of the solid particles through the opening is performed in two ways. In one of the ways, the solid particles which deposit on the metal sheet are carried outside concomitant with the movement of the metal sheet, and in the other way, the solid particles are carried out directly by an air flow through the gap present in the opening. In general, the amount of the solid particles carried out is larger in the former case, and when the volume of the cleaner chamber is increased, the amount of the solid particles which deposit on the metal sheet can be significantly decreased. On the other hand, since the floating solid particles directly flow out from the cleaner chamber through the opening of the outlet portion, the decrease in yield of the solid particles may be caused thereby in some cases.

Accordingly, in this surface treatment apparatus, only in the vicinity of the outlet portion of the cleaner chamber, the space between the upper portion of the cleaner chamber and the metal sheet is decreased to enable the solid particles floating toward the outlet portion of the cleaner chamber to collide against the inside wall of the cleaner chamber, so that the solid particles are intentionally allowed to fall onto the metal sheet.

[7] In the surface treatment apparatus for a metal sheet, described in [6], at least one cleaner chamber has an upper portion structure inclining downward toward an outlet of the cleaner chamber.

Since the upper portion of at least one cleaner chamber inclines downward toward the outlet thereof, in the surface treatment apparatus described in [6], a step is not formed at the upper portion of the cleaner chamber. Hence, the solid particles floating toward the outlet of the cleaner chamber are made to efficiently collide against the inside wall of the cleaner chamber, thereby intentionally enabling the solid particles to fall onto the metal sheet.

In the surface treatment apparatus described in [5], "the upper portion of the cleaner chamber" described in [5] does not include the portion "which inclines downward toward the outlet of the cleaner chamber" of this surface treatment apparatus. That is, the distance between this portion and the metal sheet may be 500 mm or less in some cases.

[8] The surface treatment apparatus for a metal sheet, described in any one of [2] to [7], further comprises a gas jet device in at least one cleaner chamber, the gas jet device blowing off solid particles toward the upstream side with respect to the feed direction of the metal sheet.

In the surface treatment apparatus described in [8], the gas jet device is disposed at the outlet portion of the cleaner chamber for blowing off solid particles which fell on the metal sheet toward the upstream side of the cleaner chamber, thereby blowing off the solid particles, which fell on the metal sheet, toward the inside. Hence, the solid particles are unlikely to be carried outside. In particular, according to the surface treatment apparatus of each of [6] and [7] described above, since solid particles about to directly flow out of the cleaner chamber through the opening of the outlet are intentionally allowed to fall once onto the metal sheet and are then blown off toward the inside, most of the solid particles are not carried out from the cleaner chamber through the opening.

[9] The surface treatment apparatus for a metal sheet, described in any one of [2] to [8], further comprises a particle removing device provided at the downstream side of the cleaner chamber, the device having a gas jet device and a suction device disposed to face thereto.

By the surface treatment apparatus in each of [2] to [8], most of the solid particles blasted in the blast chamber are not substantially carried outside the cleaner chamber through the outlet portion thereof, and hence the problem of decrease of the particles with time, which occurs when the solid particles are circulated for reuse, may not arise. However, the case in which a small amount of solid particles remains on the metal sheet may occur in some cases, and unless the solid particles as described above are not removed, a problem in terms of cleanness of the surface of the metal sheet occurs. Hence, in the surface treatment apparatus according to [9], in order to totally remove the solid particles remaining on the surface of the metal sheet, a high-pressure gas particle removing device is disposed at the outlet side of the cleaner chamber, the device having a gas jet device and a suction device disposed to face thereto.

The high-pressure gas particle removing device is formed of a gas jet nozzle jetting a high-pressure gas to the surface of the metal sheet and a suction device disposed to face thereto. The high-pressure gas serves to separate the solid particles remaining on the surface of the metal sheet therefrom and to disperse the particles. In particular, since the metal sheet fed at a high speed generates an accompanying air flow, even when the solid particles are to be removed, the accompanying air flow functions as one type of protective layer, and hence the solid particles must be dispersed by jetting a high-pressure gas which overwhelms the accompanying flow.

In addition, the suction device is provided in a direction to which the solid particles are dispersed by a high-pressure gas and is a device generating an air flow from an opening to the inside. According to this device, the solid particles dispersed from the metal sheet by jetting of a high-pressure gas can be collected. That is, the solid particles are not dispersed outside by jetting of a high-pressure gas and do not again fall onto the metal sheet, and hence surrounding environment is not deteriorated.

[10] The surface treatment apparatus for a metal sheet, described in any one of [2] to [8], further comprises a particle removing device provided at the downstream side of the cleaner chamber, the device being composed of a brush roll and a suction device.

The brush particle removing device is a device having a brush roll rotating while it is brought into contact with the surface of the metal sheet and the suction device disposed so as to cover the brush roll, and while the solid particles remaining on the metal sheet are swept by the brush roll, the solid particles are removed from the metal sheet by suction air in a suction duct. By using the brush roll, the solid particles remaining on the metal sheet are effectively removed from the surface of the metal sheet and can be dispersed, and in addition, the solid particles are sucked by the suction device; hence, the solid particles are prevented from being dispersed outside. Accordingly, since the solid particles are not dispersed outside the brush particle removing device and do not again fall onto the metal sheet, the cleanness of the metal sheet is not deteriorated.

[11] The surface treatment apparatus for a metal sheet, described in any one of [2] to [8], further comprises a particle removing device at an outlet side of the cleaner chamber, the device including an adhesive roll which has an adhesive surface, wherein the adhesive roll is pressed onto the metal sheet.

The adhesive-roll particle removing device is a device removing the solid particles from the surface of the metal sheet by pressing the adhesive roll having an adhesive surface onto the surface described above so that the solid particles remaining on the metal sheet are transferred to the adhesive roll surface. While prevented from being dispersed outside, the solid particles remaining on the metal sheet can be removed, and the cleanness of the metal sheet can be improved.

[12] The surface treatment apparatus for a metal sheet, described in any one of [2] to [8], further comprises at least two particle removing devices provided at an outlet side of the cleaner chamber, which are selected from the group consisting of a particle removing device having a gas jet device and a suction device disposed to face thereto, a particle removing device having a brush roll and a suction hood, and a particle removing device having an adhesive roll which has an adhesive surface and which is pressed onto the metal sheet.

The high-pressure gas particle removing device having the gas jet device and the suction device disposed to face thereto, an adhesive-roll particle removing device having the brush roll and the suction hood, and the particle removing device having the adhesive roll which has an adhesive surface and which is pressed onto the metal sheet can be independently used; however, depending on the amount of the solid particles remaining on the metal sheet, the solid particles may not be totally removed by the single means in some cases. In particular, even when the efficiency of removing solid particles is high, it is very difficult in many cases to remove all the solid particles without leaving even a single particle behind. Hence, when the devices are used in combination, a metal sheet having higher cleanness can be manufactured.

For example, when the amount of the solid particles remaining on the metal sheet is relatively large, the high-pressure gas particle removing device described above is a suitable device for removing most of the solid particles described above. However, when the line speed is increased, the influence of the accompanying flow concomitant with the movement of the metal sheet becomes significant, and as a result, it becomes difficult to remove most of the solid particles remaining on the surface of the metal sheet in some cases.

On the other hand, since the brush particle removing device is to sweep the solid particles remaining on the metal sheet with the brush, a superior effect of removing the solid particles can be obtained regardless of the line speed; however, in order to remove a relatively large amount of the solid particles, when the density of bristles of the brush or the like is not properly selected, solid particles may adhere to the bristles of the brush, and the particles may not be effectively removed in some cases.

Accordingly, for example, by disposing the brush particle removing device at the downstream side of the high-pressure gas particle removing device, most of the solid particles remaining on the surface of the metal sheet can be removed by the high-pressure gas particle removing device at the outlet side of the cleaner chamber, and in addition, a small amount of the remaining solid particles can be substantially totally removed by the brush particle removing device.

In addition, in the adhesive-roll particle removing device, when solid particles are once transferred to the adhesive roll, unless the particles thus transferred are removed from the adhesive roll surface, removal of solid particles from the surface of the metal sheet cannot be repeatedly performed. Hence, when a very small amount of the solid particles remains on the metal sheet, the device described above is suitable for removing substantially all the particles. Accordingly, by further disposing the adhesive-roll particle removing device at the downstream side of the brush particle removing device, even when a relatively large amount of the solid particles remains on the metal sheet at the outlet side of the cleaner chamber, the cleanness of the surface of the metal sheet can be further improved.

[13] In the surface treatment apparatus for a metal sheet, described in [1], the cleaning means comprises at least one washing device for washing the surface of the metal sheet.

In this surface treatment apparatus, after the solid particles are blasted onto the surface of the metal sheet, the metal sheet coming outside the blast chamber is allowed to pass through the washing device without jetting compressed air thereto. Accordingly, the case may not occur in which the solid particles remaining on the metal sheet are blown up to the periphery and then fall thereto, or the case may also not occur in which the solid particles dispersed to the periphery adhere to conveyor rolls and cause damage to the metal sheet; hence, other mechanical parts are not adversely influenced. That is, since the solid particles are washed out from the metal sheet together with a washing liquid, the metal sheet is cleaned, and in addition, the solid particles are not dispersed to the periphery.

As the washing device of the present invention, a device for washing the metal sheet with water may be satisfactorily used, and the flow rate thereof may be large enough when the solid particles on the metal sheet are washed out. However, since the efficiency of removing the solid particles is improved when pressurized water is jetted to the metal sheet, pressurized water at a pressure of 10 kgf/cm$^2$ or less may be well used. In addition, the addition of a surfactant to washing water also efficiently enhances the effect of washing out the solid particles.

Furthermore, after stored in a washing liquid pit, the solid particles washed out together therewith can only be collected using a filter or the like. After being dried, the solid particles thus collected are supplied to a hopper of the blasting device for solid particles and can be reused. Since the solid particles carried outside the blast chamber can be reused, the yield of the solid particles can be significantly improved.

[14] The surface treatment apparatus for a metal sheet, described in [13], further comprises a forced drying device for the metal sheet disposed at the downstream side of the washing device.

In this surface treatment apparatus, since the forced drying device for a metal sheet is disposed at the downstream side of the washing device, the degree of cleanness of the metal sheet can be improved. That is, from the metal sheet washed by the washing device, most of the solid particles are removed; however, a very small amount of the solid particles may remain on the metal sheet in some cases. In particular, minute cracks may be formed at the sheet edge portions of the metal sheet in some cases, and in the case described above, a small amount of the solid particles may be trapped in the cracks together with a washing liquid. In this case, since the surface tension of the liquid works, the solid particles cannot be easily removed; however, when the metal sheet is once dried so as to evaporate the residue of the washing liquid, the solid particles can be easily removed.

As the forced drying device, a device in which a washing liquid remaining on the surface of the metal sheet after washing can be evaporated is satisfactorily used, and a hot-air drier or an electric heating drier may be used. Accordingly, drying of the metal sheet and air wiping which will be described later can also be simultaneously performed in the forced drying device.

[15] The surface treatment apparatus for a metal sheet, described in [14], further comprises a gas wiping device for the metal sheet provided at the downstream side of the forced drying device.

In order to remove the solid particles after drying, it is sufficient when compressed air is jetted, and by this treatment, since a very small amount of the solid particles only remains, the problem of floating of the solid particles as described above will not occur. Hence, as the air wiping device, it is satisfactory when air nozzles are only disposed. In addition, since compressed air is not necessary to be jetted to the entire surface of the metal sheet, the air nozzles may be disposed at the periphery of the sheet edge portions of the metal sheet so that the air flows from the central portion of the sheet to the sheet edge portions.

The surface treatment apparatus as described above is disposed in a line for producing a metal sheet and is used for producing a metal sheet having superior surface properties. For example, the apparatus is disposed at at least one of the upstream side and the downstream side of a temper rolling apparatus provided at a back stage of a producing line of a hot-dipped steel sheet or a back stage of a continuous annealing line and is used for producing a hot-dip zinc-coated steel sheet or a cold-rolled steel sheet having superior surface properties.

As described above, the surface treatment apparatus and the temper rolling apparatus are preferably used in combination; however, in the producing line of a hot-dipped steel sheet or the continuous annealing line, the temper rolling apparatus may only be disposed, and the surface treatment apparatus for a metal sheet may be provided in a separate line so that the surface treatment is performed by batch treatment.

In the present invention, for example, the hot-dipped steel sheet described above includes a hot-dip zinc-coated steel sheet, an alloyed hot-dip zinc-coated steel sheet, a hot-dip Al—Zn alloy-coated steel sheet, and a hot-dip Zn—Al alloy-coated steel sheet. In addition, the surface properties are properties having influences on the quality of the steel sheet, such as the press formability and the clearness after painting.

Furthermore, the present invention provides the following methods for producing a metal sheet.

[16] A method for producing a metal sheet, comprises the steps of:

blasting solid particles having an average particle diameter of 300 μm or less onto a surface of the metal sheet which is continuously fed; and removing solid particles which float or adhere to the surface of the metal sheet onto which the solid particles are blasted.

[17] In the method for producing a metal sheet, described in [16], the step of removing solid particles, comprises blowing a gas onto the metal sheet so as to blow off the solid particles, and removing solid particles which are blown off by suction.

[18] The method for producing a metal sheet, described in [17], further comprises at least one step selected from the group consisting of a step of, while solid particles remaining on the metal sheet are blown off by blowing a gas onto the metal sheet, removing solid particles from the surface of the metal sheet by sucking a gas; a step of, while the solid particles remaining on the metal sheet are swept by a brush roll, removing solid particles from the surface of the metal sheet by sucking a gas; and a step of removing the solid particles remaining on the surface of the metal sheet by pressing an adhesive roll thereto.

[19] The method for producing a metal sheet, described in [16], further comprises the step of performing forced drying of the surface of the metal sheet before the solid particles are blasted onto the metal sheet.

[20] The method for producing a metal sheet, described in [19], further comprises the step of washing the metal sheet before the surface of a steel sheet is processed by the forced drying.

Furthermore, the present invention provides the following surface treatment apparatus for a metal sheet.

[21] A surface treatment apparatus for a metal sheet, comprises:

a blasting device for blasting solid particles having an average particle diameter of 300 μm or less onto a surface of the metal sheet which is continuously fed; and a deposits removing device disposed at an inlet side of the blasting device for removing deposits on the surface of the metal sheet.

In this surface treatment apparatus, since particles are used which are much smaller than those used for shot blast for conventional descaling, after being made to collide against the metal sheet to form dents, the solid particles blasted from the blasting device are dispersed to the periphery and reflected inside a blast chamber or are allowed to float in the air and subsequently again fall onto the metal sheet. In this step, when the solid particles fall at the outlet side of the blasting device, even when continuously blasted, the solid particles do not deposit on the metal sheet which is continuously fed; however, the flow of the solid particles reflected in the blast chamber or the flow of the solid particles floating in the air are difficult to control, and as a result, deposition of the solid particles at the inlet side of the blasting device cannot be prevented. In particular, when a plurality of blasting devices is disposed in the same blast chamber, the control of the deposition behavior of the solid particles becomes more difficult.

This surface treatment apparatus was invented based on the idea in that even when the floating solid particles fall at the inlet side of the blasting device, as long as the solid particles present on the metal sheet are removed right before the blasting, the formation of the surface roughness by the blasting device is not interfered with. That is, right before the solid particles are blasted for forming the surface roughness on the surface of the metal sheet, solid particles present in that region by deposition may be removed by the deposit removing device. Accordingly, the removing device for removing the solid particles is preferably disposed at a position located as close as possible to the inlet side of the blasting device.

The distance between the deposit removing device and the blasting device is preferably as small as possible. The reason for this is that although the solid particles are removed from the surface of the metal sheet, dispersed solid particles may deposit on the metal sheet before the surface roughness is formed by the blasting device. However, in the case in which the line speed is approximately 100 mpm, as long as the distance between the deposit removing device and the blasting device is 500 mm or less, even when the solid particles fall onto the metal sheet, the deposition thereof is not serious so that the formation of surface roughness is interfered with. However, since the deposition amount is increases as the blast amount of the solid particles is increased, the distance described above must be decreased. In addition, as the line speed is decreased, since the solid particles may have room to deposit in terms of time, the distance must be decreased.

In addition, it is not always necessary that the range in which the solid particles are removed be the entire width direction of the metal sheet, and the solid particles may be removed or is preferably removed only in the range along the width direction in which the surface roughness can be formed by a single blasting device. The reason for this is that when solid particles which deposit in the range in which the surface roughness is not formed are removed, the amount of the solid particles dispersed in the air is increased, and as a result, adverse influences may occur in some cases.

[22] In the surface treatment apparatus for a metal sheet, described in [21], the deposit removing device comprises at least one selected from the group consisting of a gas jet device and a suction device.

As the deposits removing device, a method for blowing off by jetting gas, a suction method for sucking solid particles using a suction blower, or a mechanical removing method using a scraper or the like may be used. However, a mechanical removing device such as a scraper may be brought into contact with the metal sheet which is being fed, and hence, for a product such as a zinc-plated steel sheet or a cold-rolled steel sheet, which is required to have superior appearance, this device is not preferable. In this means, since the gas jet device or the suction device is used as the deposit removing device, the deposits removing device is not brought into contact with the metal sheet which is being fed, and as a result, the problem described above can be prevented.

[23] The surface treatment apparatus for a metal sheet, described in [21] or [22], further comprises a deposits measurement device provided at the inlet side of the blasting device for measuring the surface of the metal sheet.

The deposit measurement device is a device which measures the amount of a deposit or determines whether the amount of a deposit is a predetermined amount or more. In this surface treatment apparatus, since the deposit measurement device for the surface of the metal sheet is provided at the inlet side of the blasting device, this measurement means determines whether the solid particles deposit on the metal sheet or determines the deposit amount of the solid particles, and according to the result thus obtained, the output of the solid particle removing device can be adjusted. In particular, when the solid particles deposit, the pressure or the flow rate of the gas jet device may be increased, or the suction force of the suction device may be increased. In addition, in accordance with the deposit amount of the solid particles, the pressure or the flow rate of the gas jet device or the suction force of the suction device is adjusted. Accordingly, the solid particle removing device can be operated under preferable conditions.

[24] In the surface treatment apparatus for a metal sheet, described in [23], the deposits measurement device measures reflected light from the surface of the metal sheet, and from the measurement result thereof, the amount of the deposit is determined.

Since a zinc-plated steel sheet and a cold-rolled steel sheet used in the present invention have metallic gloss, regular reflection intensity of light is increased. On the other hand, when fine solid particles deposit on the steel sheet, the reflection intensity of light is rapidly decreased. Hence, when light is emitted from a light-emitting device, and the reflected light thereof is measured, the presence of the deposit on the surface of the metal sheet or the amount thereof can be precisely determined. As the reflected light measurement device, well-known optical sensors may be optionally used.

Furthermore, the present invention provides the following methods for producing a metal sheet.

[25] A method for producing a metal sheet, comprises the steps of:

cleaning a surface of the metal sheet; and blasting solid particles onto the cleaned metal sheet.

In this method for producing a metal sheet, although floating solid particles fall at the inlet side of a blasting device, since the formation of surface roughness by the blasting device is not interfered with, a metal sheet having a targeted surface roughness can be manufactured.

[26] In the method for producing a metal sheet, described in [25], the step of cleaning a surface of the metal sheet comprises at least one of blowing a gas onto the metal sheet and sucking a gas so as to clean the surface of the metal sheet.

In this method for producing a metal sheet, while a risk is avoided in that the deposit removing device is brought into contact with the metal sheet which is being fed, a metal sheet having a targeted surface roughness can be manufactured.

[27] In the method for producing a metal sheet, described in [25], the step of cleaning a surface of the metal sheet comprises measuring the amount of a deposit on the surface of the metal sheet, and adjusting an output of a removing device of removing the deposit in accordance with the measurement result so as to clean the surface of the metal sheet.

In this method for producing a metal sheet, while the solid particle removing device is operated under preferable conditions, a metal sheet having a targeted surface roughness can be manufactured.

Furthermore, the present invention provides the following surface treatment apparatus for a metal sheet.

[28] A surface treatment apparatus for a metal sheet, comprises:

a blasting device for blasting solid particles having an average particle diameter of 300 μm or less onto a surface of the metal sheet which is continuously fed;

a blast chamber in which the blasting device is disposed; and a forced drying device for the metal sheet disposed at the upstream side of the blast chamber.

When a liquid film remaining on the metal sheet in a previous step or the like is processed by forced drying beforehand so that the remaining liquid is evaporated, although the solid particles are subsequently blasted onto the surface of the metal sheet, a problem in that the solid particles adhere to the metal sheet will not occur. Hence, for example, problems may not arise in that the yield is largely decreased since the solid particles adhering to the metal sheet are carried outside the system and in that an appropriate surface roughness cannot be formed since the collision speed of the solid particles is decreased due to a buffer effect of wet portions. In addition, clogging of pipes or the like caused by the solid particles will not occur.

[29] The surface treatment apparatus for a metal sheet, described in [28], further comprises a washing device for the metal sheet which is disposed at the upstream side of the forced drying device.

In the case in which surface roughness or the like is formed by blasting the solid particles onto the metal sheet, when foreign materials such as abraded components adhere to the surface of the metal sheet, the surface roughness or the like cannot be effectively formed. Hence, the metal sheet can be dried beforehand. As the washing device, a method for jetting water to the metal sheet is economical, and as a jet pressure, in general, 10 kgf/cm$^2$ or less may be satisfactorily used. However, in order to remove foreign materials tightly adhering to the surface of the metal sheet, more pressurized water may be jetted in some cases.

Furthermore, the present invention provides the following methods for producing a metal sheet.

[30] A method for producing a metal sheet, comprises the steps of:

performing forced drying of a surface of the metal sheet which is continuously fed; and blasting solid particles having an average particle diameter of 300 μm or less onto the surface of the dried metal sheet.

[31] The method for producing a metal sheet, described in [30], further comprises washing the metal sheet before the metal sheet is processed by the forced drying.

[32] The surface treatment apparatus for a metal sheet, described in any one of [1] to [12], further comprises a deposit removing device at an inlet side of the blasting device, the deposit removing device removing a deposit on the surface of the metal sheet.

[33] The method for producing a metal sheet, described in any one of [16] to [18], further comprises the step of cleaning the surface of the metal sheet which is continuously fed before the step of blasting the solid particles.

[34] The surface treatment apparatus for a metal sheet, described in any one of [1] to [12], further comprises a forced drying device for the metal sheet disposed at the upstream side of the blasting device.

[35] The method for producing a metal sheet, described in any one of [16] to [18], further comprises the step of performing forced drying of the surface of the metal sheet which is continuously fed before the step of blasting the solid particles.

[36] The surface treatment apparatus for a metal sheet, described in any one of [1] to [12], further comprises:

a washing device for the metal sheet disposed at the upstream side of the blast chamber;

a forced drying device disposed at the downstream side of the washing device; and a deposit removing device for removing a deposit on the surface of the metal sheet, the deposit removing device being disposed at an inlet side of the blast chamber.

[37] The method for producing a metal sheet, described in one of [16] to [18], further comprises the steps of, before the step of blasting the solid particles:

washing the surface of the metal sheet;

performing forced drying of the washed metal sheet; and removing a deposit on the surface of the metal sheet.

[38] A treatment system for a metal sheet, comprises: a hot-dip plating line; and the surface treatment apparatus for a metal sheet, described in any one of [32], [34], and [36], provided at the downstream side of a cooling device or an alloying furnace, which is provided after a plating bath of the hot-dip plating line.

[39] A treatment system for a metal sheet, comprises: a continuous annealing line; and the surface treatment apparatus for a metal sheet, described in any one of [32], [34], and [36], provided at the downstream side of an annealing furnace of the continuous annealing line.

EMBODIMENT FOR CARRYING OUT THE INVENTION

Embodiment 1

Figure 1:
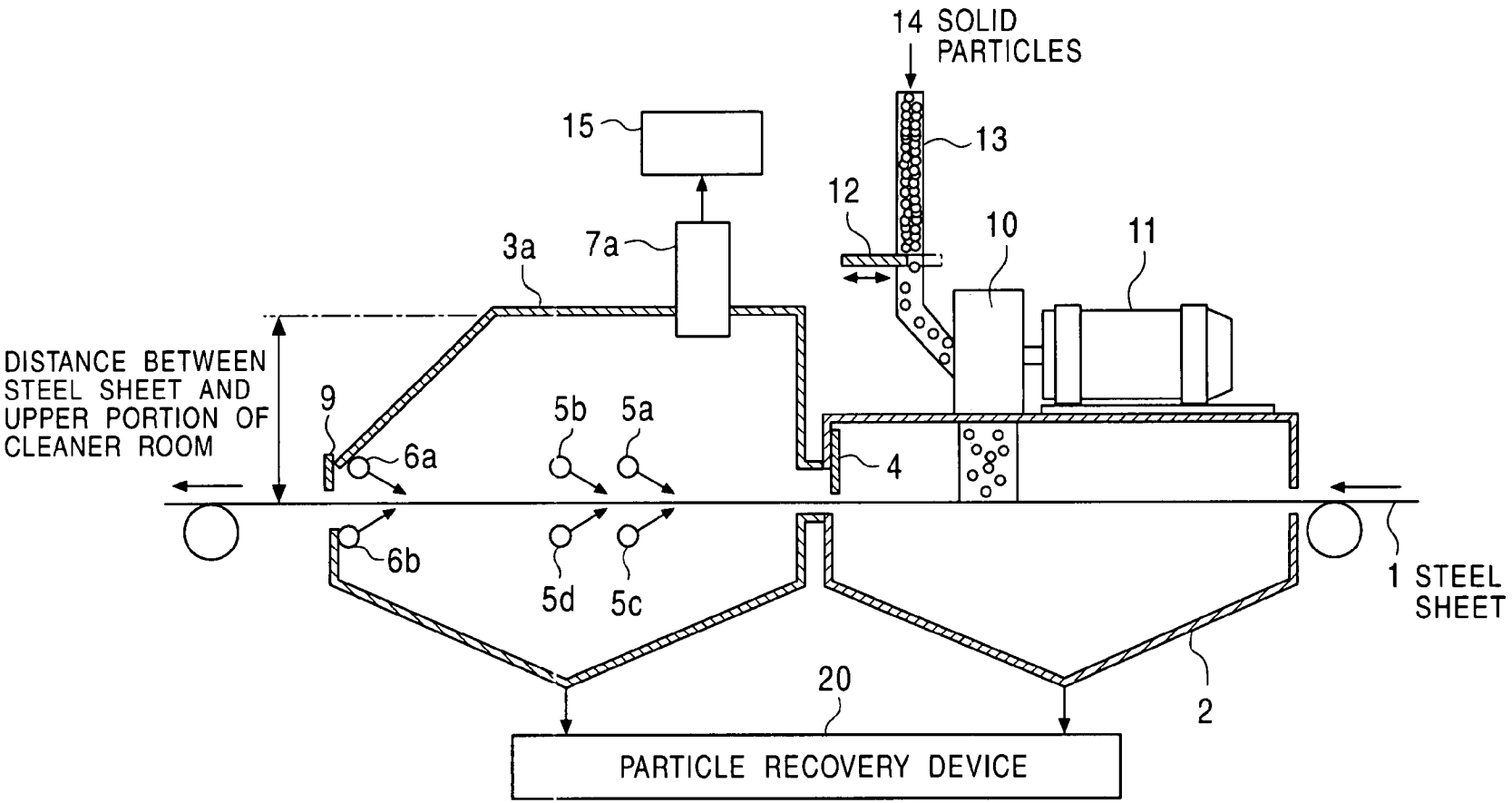
FIG. 1 is a schematic view showing a surface treatment apparatus for a metal sheet, according to embodiment 1-1.

FIG. 1 is a view schematically showing s surface treatment apparatus for a metal sheet, according to embodiment 1-1. In the figure, the state is shown in which surface roughness is formed on a surface of a metal sheet by a centrifugal rotor blasting device while a metal sheet 1 is continuously fed. The centrifugal rotor blasting device is a device which accelerates solid particles 14 by a vane 10 driven by a motor 11 using a centrifugal force. The solid particles 14 stored in a tank or the like are supplied to the vane 10 through a particle supply tube 13. In the midway of the path mentioned above, an opening adjusting valve 12 is provided, and by adjusting the degree of opening thereof, the supply amount of the solid particles 14 can be controlled.

In FIG. 1, the state is shown in which the solid particles are blasted only onto the top surface of the metal sheet 1; however, a device similar to that described above may be provided at the bottom surface side of the metal sheet 1 so that the solid particles may be supplied onto two sides of the metal sheet 1. In addition, a plurality of blasting devices may be disposed in the width direction and in the longitudinal direction of the metal sheet 1. A solid particle blast portion is disposed in a blast chamber 2, so that the solid particles 14 thus blasted are prevented from being dispersed outside. Inside the blast chamber 2, the solid particles 14 thus blasted are made to collide against the surface of the metal sheet, and after dimple-shaped dents are formed thereby, the particles are reflected and are then dispersed to the periphery. Most of the particles are to fall to a lower portion of the blast chamber 2.

In particular, by an airflow generated by the rotation of the vane 10, most of the particles are removed from the metal sheet 1 and fall to the lower portion of the blast chamber. The solid particles 14 which fell are recovered by a particle recovery device 20 and are then blasted while being circulated. However, after part of the solid particles 14 blasted in the blast chamber reflect inside the blast chamber and then float therein, they again fall onto the metal sheet and are then carried out from the blast chamber. Alternatively, the particles described above may be evacuated from the blast chamber with an accompanying flow generated when the metal sheet 1 is fed at a high speed.

Openings are present at an inlet portion and an outlet portion of the blast chamber 2 so that constituent elements of the blast chamber 2 are not brought into contact with the metal sheet 1 and are prevented from causing scratches thereon. At the outlet portion of the blast chamber 2, a rubber plate 4 or the like is provided, and hence the blast chamber 2 is partitioned from a cleaner chamber 3*a*. The rubber plate 4 used between the cleaner chamber 3*a* and the blast chamber 2 is preferably provided so as not to be in contact with the metal sheet; however, when the contact is made just by slightly pushing, since scratches may not be generated at all, the rubber plate 4 may have the contact as described above with the metal sheet.

Inside the cleaner chamber 3*a*, gas jet devices 5*a* to 5*d* are provided. The gas jet devices each have a gas jet nozzle for blowing off the solid particles 14 which deposit on the metal sheet 1. These gas jet devices are not always necessary to be disposed at the bottom surface of the metal sheet 1; however, a flow rate, a pressure, and the number of nozzles must be ensured which are sufficient for blowing off the solid particles 14 present on the top surface of the metal sheet. For example, in the case in which stainless steel particles having an average particle diameter of 85 μm are used as the solid particles 14, and in which a high-pressure air nozzle is used as a gas jet nozzle, a capacity having approximately an air pressure of 0.3 MPa and an airflow rate of approximately 0.3 $m^3$/min may be satisfactory.

In addition, in accordance with the blast amount of the solid particles 14 blasted in the blast chamber 2 and the line speed, the number of nozzles disposed along the feed direction of the metal sheet 1 is determined so that the solid particles 14 on the metal sheet 1 are sufficiently blown off. In addition, in accordance with the sheet width of the metal sheet 1, the arrangement of the nozzles in the width direction is preferably determined. That is, the nozzles are disposed so that the gas flows thereof are not interfered with each other. In addition, when blower air is used for the gas jet device, under the conditions wherein the sheet width, the line speed, and the blast amount of the particles in the blast chamber 2 are set to 1,000 mm, 50 mpm, and 600 kg/min, respectively, the gas flow rate must be set to 40 $m^3$/min or more by using a slit nozzle.

In addition, in FIG. 1, the distance between the upper portion of the cleaner chamber 3*a* and the metal sheet 1 is set to at least 500 mm. Since the volume of the cleaner chamber requires a space in which the solid particles blown off by the gas jet devices 5*a* to 5*d* are allowed to float for a long period of time, the larger volume is more preferable. Accordingly, from this point of view, the distance between the upper portion of the cleaner chamber 3*a* and the metal sheet 1 is set as described above.

Furthermore, in FIG. 1, as the structure of the cleaner chamber 3*a*, the height thereof is inclined downward toward the outlet side, and gas jet devices 6*a* and 6*b* are disposed at the outlet portion of the cleaner chamber 3*a*. The reasons for this is that the inclined upper portion of the cleaner chamber 3*a* prevents the solid particles blown off by the gas jet devices 5*a* to 5*d* from being dispersed toward the downstream side by reflection in the cleaner chamber 3*a* and enables the particles to fall onto the metal sheet so that the gas jet device 6*a* blows off the particles on the metal sheet toward the upstream side of the cleaner chamber 3*a*.

In addition, the gas jet device 6*b* is disposed to prevent the solid particles 14 from being carried outside of a system (outside of the system which is made of the cleaner chamber 3*a* and a device in which solid particles are recovered for reuse by circulation) through the opening of the outlet of the cleaner chamber 3*a* by an accompanying airflow generated by the movement of the metal sheet 1. In addition, the gas jet devices 6*a* and 6*a* may have a flow rate approximately equivalent to or smaller than that of the gas jet devices 5*a* to 5*d*. The reason for this is that most of the solid particles 14 are already allowed to float in the cleaner chamber 3*a*.

In addition, a rubber curtain 9 may be fitted to the outlet of the cleaner chamber 3*a* so that the solid particles 14 are prevented from escaping through the opening. The rubber curtain 9 is preferably fitted so as not to be brought into contact with the metal sheet 1. The reason for this is that when the rubber curtain 9 is brought into contact with the metal sheet 1, scratches may be directly formed thereon, or that the solid particles 14 may break into the rubber curtain 9 so as to generate surface defects in some cases.

On the other hand, in general, the solid particles 14 floating in the cleaner chamber 3*a* by the gas jet devices 5*a* to 5*d* or 6*a* and 6*b* fall to the lower portion of the cleaner chamber 3*a*, are then recovered by the particle recovery device 20, and subsequently are reused by circulation. However, when the metal sheet 1 is continuously fed, and the concentration of the solid particles 14 floating in the cleaner chamber 3*a* is increased, the solid particles 14 interfere with each other and are then likely to fall onto the metal sheet 1. Accordingly, in order to prevent the interference described above, in addition to the particle recovery device 20, a particle suction device 7*a* is provided which sucks the floating solid particles 14 from the above.

The particle suction device 7*a* is connected to a dust collector 15, and the floating solid particles 14 are sucked by a suction air generated by a blower. However, the capacity is not necessary to be large enough to suck all the solid particles 14 floating inside the cleaner chamber. The reason for this is that until the concentration of the solid particles 14 in the cleaner chamber 3*a* reaches a certain level, due to the air purge effect, the solid particles 14 are not so much likely to fall onto the metal sheet 1 inside the cleaner chamber 3*a*. In addition, the reason for this is that most of the solid particles 14 blown off from the metal sheet 1 fall to the lower portion of the cleaner chamber 3*a* and are then recovered by the particle recovery device 20. Accordingly, in practice, a capacity of sucking approximately 5% of the solid particles 14 carried into the cleaner chamber 3*a* may be good enough.

As the amount of the solid particles 14 which are blasted in the blast chamber 2 is increased, the amount of particles carried into the cleaner chamber 3*a* is increased; hence, in accordance with the increase in concentration thereof, the suction flow rate of the particle suction device 7*a* may be changed.

In addition, when a classify device such as a cyclone is provided between the particle suction device 7*a* and the dust collector 15 so that a circulation system is formed in which solid particles having a predetermined size or more are returned to the particle recovery device 20 or the like, the solid particles sucked by the particle suction device 7*a* can be reused. Accordingly, although the suction flow rate is set to large so as to suck a large amount of the solid particles from the cleaner chamber 3*a*, since the solid particles are returned to the circulation system by the classify device, the amount of the solid particles collected by the duct collector 15 is not increased, and hence the amount of the solid particles in the circulation system is not so much decreased.

Inside the blast chamber 2, a gas jet device is not always necessary to be provided; however, in order to decrease the amount of the solid particles carried out from the blast chamber 2 to the cleaner chamber 3*a*, a gas jet device may be provided. However, the gas flow rate and the pressure used for blowing off the solid particles 14 must be controlled so as not to interfere with the flow of the solid particles 14 toward the metal sheet 1 from a blasting device 10.

Figure 2:
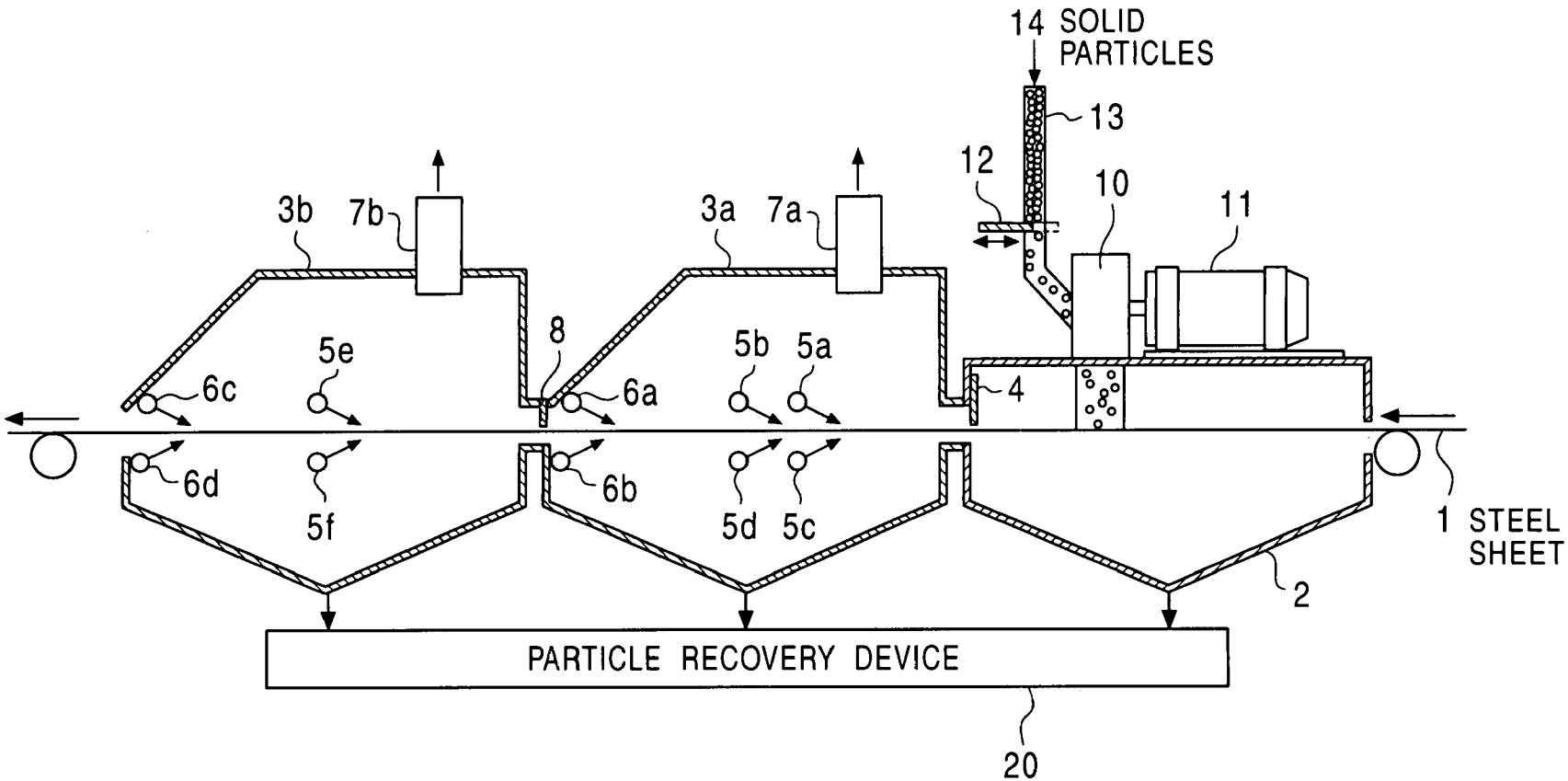
FIG. 2 is a schematic view showing a surface treatment apparatus for a metal sheet, according to embodiment 1-2.

FIG. 2 is a view showing an embodiment 1-2 in which two cleaner chambers are continuously provided beside the blast chamber 2. At the downstream side of the cleaner chamber 3*a*, another cleaner chamber 3*b* is disposed, and the cleaner chambers described above are partitioned from each other with the rubber curtain 8. The structures of the blast chamber 2 and the cleaner chamber 3*a* are the same as those shown in FIG. 1, and hence descriptions thereof are omitted.

Inside the cleaner chamber 3*b*, gas jet devices 5*e* and 5*f* are provided for removing the solid particles 14 from the metal sheet 1, and at the upper portion of the cleaner chamber 3*b*, a suction device 7*b* is provided. In addition, at the outlet of the cleaner chamber 3*b*, gas jet devices 6*c* and 6*d* are disposed so that the solid particles 14 are not carried out from a cleaner chamber system.

However, in the cleaner chamber 3*a* located at the upstream side, a large amount of the solid particles 14 carried out from the blast chamber 2 is removed, and the amount of the solid particles 14 carried into the cleaner chamber 3*b* located at the downstream side is relatively small; hence, the volume of the cleaner chamber 3*b* is not necessary to be as large as that of the cleaner chamber 3*a* located at the upstream side. In addition, it is not always necessary to provide the particle suction device 7*b*, and a blowing-off capacity by jetting gas may be smaller than that in the cleaner chamber 3*a* at the upstream side.

Figure 3:
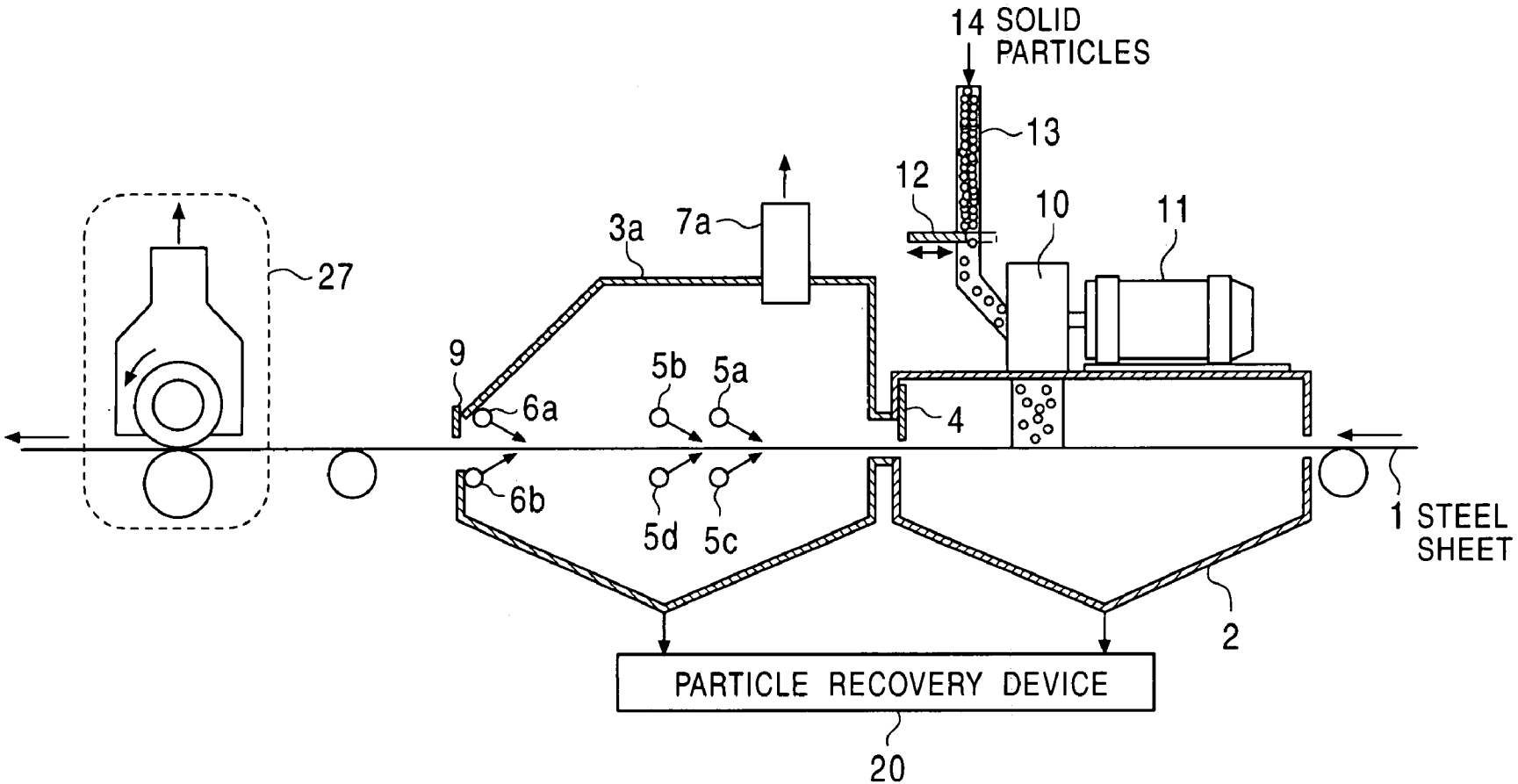
FIG. 3 is a schematic view showing a surface treatment apparatus for a metal sheet, according to embodiment 1-3.
Figure 4:
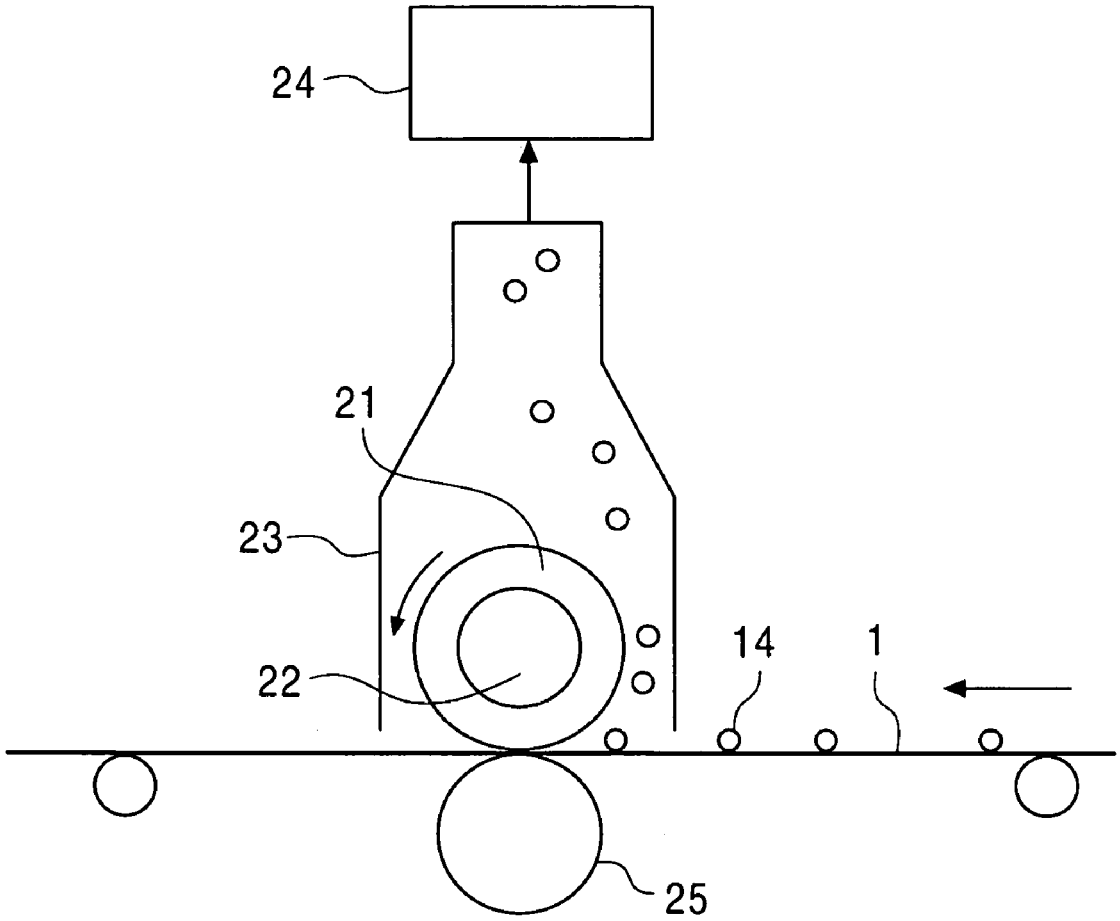
FIG. 4 is a view showing a brush particle removing device used in embodiment 1.

FIG. 3 is a view showing an embodiment 1-3 in which, in addition to the cleaner chamber 3*a* provided at the outlet side of the blast chamber 2, a brush particle removing device 27 is provided at the downstream side of the cleaner chamber 3*a*. In addition, FIG. 4 is a view showing the detail of the brush particle removing device 27.

The brush particle removing device 27 is formed of a brush roll, a suction duct 23, a dust collector 24, and a back-up roll 25. The brush roll is formed of a shaft roll 22 and bristles 21 covering the periphery thereof and is designed to rotate while the brush roll is being pressed on the surface of the metal sheet. The suction duct 23 has the structure in which the solid particles 14 dispersed by the brush roll are prevented from being dispersed to the periphery. In addition, the dust collector 24 serves to create a suction gas flow for recovering the solid particles 14 dispersed in the suction duct. Furthermore, the back-up roll 25 is a roll functioning of receiving a load pressing the brush roll onto the metal sheet 1 so as to prevent the metal sheet from being warped.

In this case, as the brush roll, a roll having a diameter of approximately 200 to 500 mm is used, and the rotational speed and the load applied onto the metal sheet of the roll are preferably adjustable. A material for the bristles must have hardness to a certain extent so as not to generate damage on the surface of the metal sheet even when the bristles are pressed thereon, and engineering plastic and polypropylene fibers may be used. In addition, the diameter of the bristle is set to 1 mm or less and preferably in the range of approximately 0.01 to 1 mm. The reasons for this are that when the diameter of the bristle is large, damage may be liable to be done onto the surface of the metal sheet and that fine solid particles 14 are not suitably swept out. In addition, although there may be a roll containing abrasive grains as the brush roll in order to obtain an abrasive sweeping effect, damage is done to the surface of the metal sheet, and as a result, the roll described above is not suitably used for this object.

The suction duct 23 must have the structure covering the entire brush roll so as to prevent the solid particles 14 from being dispersed outside the suction duct. However, when the volume of the suction duct is too much increased as compared to that of the brush roll, the flow rate of the suction air must be increased; hence, the shape is preferably larger than that of the brush roll by approximately one size. In addition, the gap between the brush roll and the inner wall of the suction duct must be set to a predetermined value or less so as to ensure the flow speed for sucking the solid particles 14.

The dust collector 24 is a device having a suction blower or the like for creating a suction gas flow in the suction duct 23 and is designed to suck and collect the solid particles 14 dispersed inside the suction duct 23 by the brush. However, between the suction duct 23 and the dust collector 24, a classify device such as a cyclone may be provided so that solid particles classified thereby are returned to the particle recovery device 20. The reason for this is that since the solid particles returned to the particle recovery device 20 are again blasted onto the surface of the metal sheet, the yield of the solid particles is not decreased.

The back-up roll 25 is a roll for receiving a press force of the brush roll and may be synchronously driven by a motor with the line speed of the metal sheet. In addition, although FIG. 4 shows the structure in which the brush roll is disposed at one surface side of the metal sheet, the brush rolls may be provided at the two surface sides of the metal sheet. In this case, the back-up roll 25 becomes not necessary.

Figure 5:
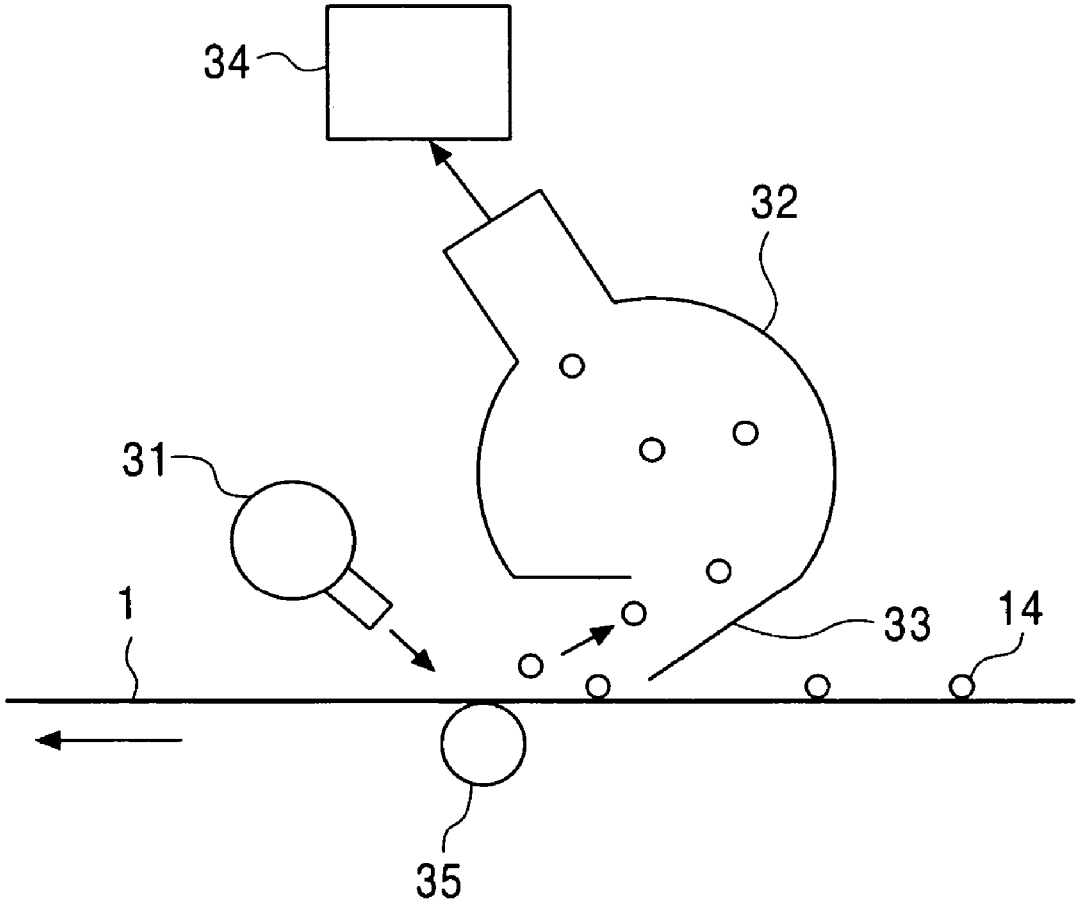
FIG. 5 is a view showing a high-pressure air particle removing device used in embodiment 1.

FIG. 5 shows a high-pressure gas particle removing device used in embodiment 1, in which a gas jet device and a suction device are disposed to face each other. The high-pressure gas particle removing device is formed of a gas jet device 31 jetting a high-pressure gas to the surface of the metal sheet and the suction device disposed to face thereto. The suction device is formed of a suction duct 32 and a dust collector 34 for sucking the solid particles 14 dispersed in the suction duct.

The gas jet device 31 is a nozzle jetting a high-pressure gas, and in order to process a metal sheet having a large width, a slit nozzle is preferably used. The reason for this is that substantially all the solid particles remaining on the metal sheet 1 can be blown off. A preferable direction in which a high-pressure gas is jetted is a direction opposite to the feed direction of the metal sheet 1 and is to be inclined with respect to the surface thereof. The reason for this is that when jetting is performed perpendicularly to the surface of the metal sheet, the solid particles are not dispersed in the direction toward the suction duct 32. In this case, a jetting flow speed of a high-pressure gas is to be determined in consideration of the size of the solid particle 14, the specific gravity, the line speed, and the like; however, since a flow speed which can reliably disperse the solid particles 14 on the metal sheet 1 must be ensured, a flow speed of 30 m/s or more is generally appropriate.

The suction duct 32 has an opening which can cover the range in which the solid particles 14 blown off by the gas jet device 31 are dispersed. In this step, a guide 33 is preferably provided so that the solid particles 14 blown off are not dispersed to the upstream side with respect to the position at which the suction duct is disposed. The guide 33 is formed of a plate using rubber or plastic and is pressed onto the metal sheet 1 so as to be lightly brought into contact therewith. When being lightly pressed, the guide may not damage the surface of the metal sheet 1. The guide 33 is to be inclined with respect to the feed direction of the metal sheet, and the slope of the guide is set so that the solid particles 14 dispersed by a high-pressure gas are smoothly introduced inside the suction duct 32.

The dust collector 34 is provided with a suction blower for sucking the solid particles dispersed inside the suction duct 32 and has a function of collecting the solid particles 14. In this step, the suction blower must have a capacity of sucking all the dispersed solid particles. In addition, a gas flow rate must be sucked which is at least larger than that jetted by the gas jet device 31, and once the flow rate is ensured larger than that as described above, a larger capacity is more preferable. In addition, in order to ensure a predetermined flow speed or more, the opening of the suction duct 32 into which the solid particles 14 dispersed by a high-pressure gas are introduced is preferably formed smaller than the inside of the suction duct 32 so that the flow speed of the suction air is increased.

A back-up roll 35 is a roll functioning of preventing the metal sheet 1 from being vibrated by jetting of a high-pressure gas. When the metal sheet 1 is vibrated, the contact state between the guide 33 and the metal sheet 1 is changed, and the solid particles 14 may be dispersed to the upstream side with respect to the position of the suction duct 32 in some cases; hence, the back-up roll 35 is provided for the prevention thereof.

In FIG. 5, the case in which the high-pressure gas particle removing device is provided only at one side surface of the metal sheet is shown; however, the same device as that described above may be provided at the bottom surface side of the metal sheet.

Figure 6:
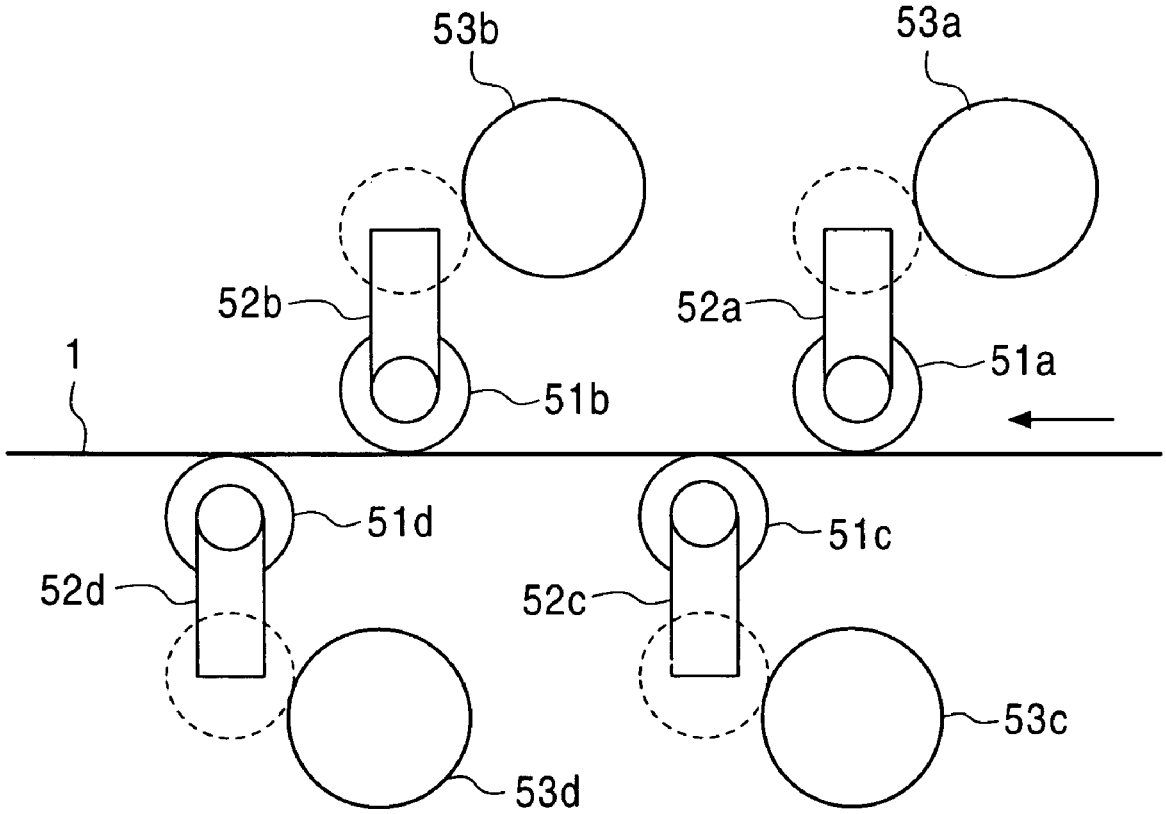
FIG. 6 is a view showing an adhesive-roll particle removing device used in embodiment 1.

FIG. 6 is a view showing an adhesive-roll particle removing device used in embodiment 1, in which an adhesive roll having an adhesive surface is pressed. In embodiment 1, on the top surface of the metal sheet 1, two adhesive rolls 51*a* and 51*b* are disposed, and on the bottom surface of the metal sheet 1, two adhesive rolls 51*c* and 51*d* are disposed.

As the rolls 51*a* to 51*d*, a roll may be used which is lined with a rubber or the like having an adhesive property, and a roll for collecting dust used in a printing machine or the like may be used. In addition, a lining layer having an adhesive property is preferably formed of a soft material having a JIS rubber hardness of approximately 10 to 30°, and hence the material as described above may not damage the surface of the metal sheet.

The adhesive rolls 51*a* to 51*d* are disposed so as to be lightly pressed onto the surface of the metal sheet 1 and are preferably provided with position-adjusting mechanisms 52*a* to 52*d* capable of adjusting a contact pressure. In addition, the position-adjusting mechanisms 51*a* to 51*d* are each capable of withdrawing the adhesive rolls 51*a* to 51*d* to a position so as not to be in contact with the metal sheet 1.

When being brought into contact with the adhesive rolls 51*a* to 51*d*, the solid particles 14 remaining on the metal sheet 1 are transferred to the surfaces of the adhesive rolls, that is, the solid particles 14 are removed from the metal sheet. In this step, since the solid particles 14 adhere onto the surfaces of the adhesive rolls 51*a* to 51*d*, the capacity of removing the solid particles 14 is decreased with time. Hence, it is necessary that the surfaces of the adhesive rolls 51*a* to 51*d* be washed periodically so as to remove the solid particles 14 from the surface of the adhesive rolls. FIG. 6 shows the structure in which washing rolls 53*a* to 53*d* are provided and are to be brought into contact with the adhesive rolls 51*a* to 51*d* at withdrawn positions thereof for removing the solid particles 14 adhering to the surfaces of the adhesive rolls.

In addition, the adhesive rolls 51*a* and 51*b* provided on the top surface of the metal sheet 1 are used as one group, and when one of the adhesive rolls is placed at the withdrawn position and in contact with the washing roll, the other adhesive roll is placed to be in contact with the metal sheet 1. Accordingly, since at least one of the adhesive rolls is always placed to be in contact with the metal sheet 1, the solid particles 14 remaining on the metal sheet 1 can be totally removed.

Figure 7:
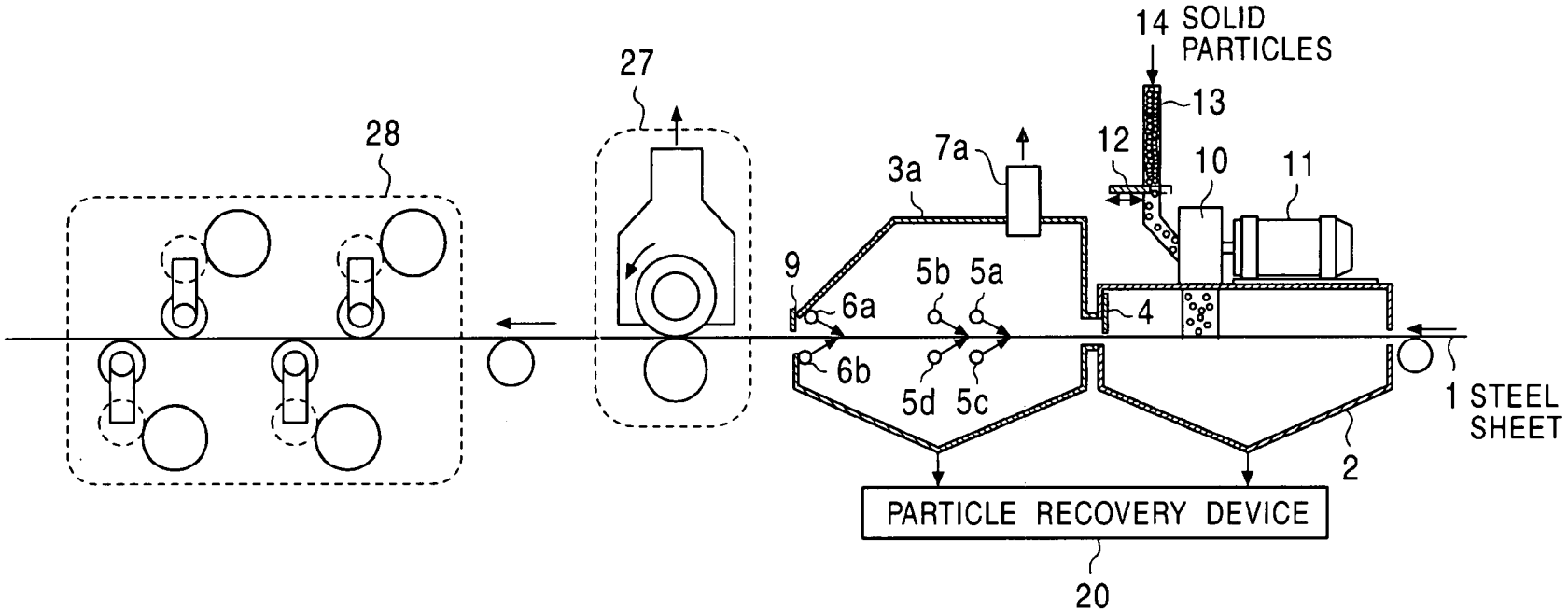
FIG. 7 is a schematic view showing a surface treatment apparatus for a metal sheet, according to embodiment 1-4.

FIG. 7 is a view showing a surface treatment apparatus for a metal sheet, according to embodiment 1-4. At the outlet side of the blast chamber 2 in which solid particles having an average particle diameter of 300 μm or less are blasted onto the metal sheet which is continuously fed, the cleaner chamber 3*a* partitioned from the blast chamber is provided, and in the cleaner chamber 3*a*, the suction device 7*a* sucking the solid particles is provided. At the downstream side of the cleaner chamber 3*a*, the brush particle removing device 27 formed of the brush roll and the suction duct is provided. Furthermore, at the downstream side thereof, an adhesive-roll particle removing device 28 is provided which presses the adhesive rolls each having an adhesive surface thereof.

In embodiment 1-4, by blasting the solid particles in the blast chamber 2, a large amount of solid particles is carried into the cleaner chamber 3*a* and is allowed to float in a large space, followed by suction of the solid particles, and hence most of the solid particles are removed from the surface of the metal sheet 1. However, a small amount of the solid particles may remain on the surface of the metal sheet 1 in some cases, and they are to be removed by the brush particle removing device 27. Instead of removing a large amount of the solid particles from the metal sheet, the brush particle removing device 27 is preferably used for totally removing a small amount of the remaining particles.

Furthermore, in order to ensure the degree of cleanness of the surface of the metal sheet by totally removing the solid particles, when the adhesive-roll particle removing device 28 is disposed at the downstream side of the brush particle removing device 27, the solid particles can be totally removed from the surface of the metal sheet 1. The reason for this is that the adhesive rolls are suitable for totally removing an extremely small amount of solid particles and are not suitable for removing a large amount of solid particles.

As described above, by further disposing a plurality of the solid particle removing devices at the downstream side of the cleaner chamber 3*a*, the solid particles remaining on the metal sheet 1 can be effectively removed.

Figure 9:
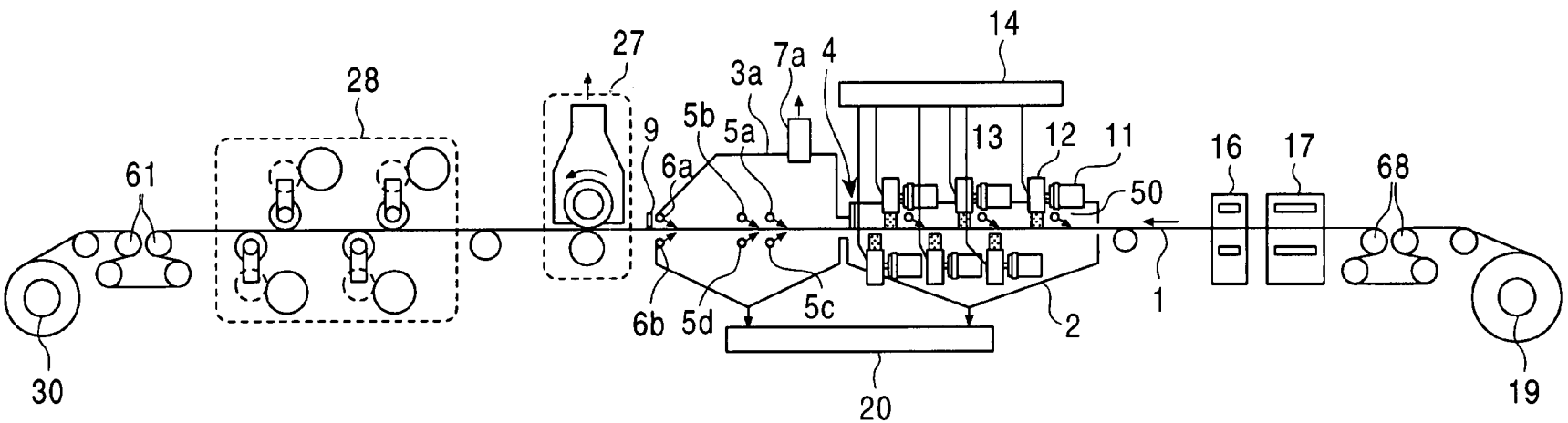
FIG. 9 is a schematic view showing a surface treatment apparatus for a metal sheet, according to embodiment 1-5.

FIG. 9 is view showing a surface treatment apparatus for a metal sheet, according to embodiment 1-5. At the upstream side of the blast chamber 2, an inlet-side forced drying device 16 for a metal sheet and an inlet side washing device 17 are continuously disposed. In this case, while a tension is applied to the metal sheet between an inlet-side bridle roll 68 and an outlet-side bridle roll 61, the metal sheet 1 is continuously fed. The metal sheet to be charged to a payoff reel 19 is a metal sheet processed by temper rolling or the like in a preceding step, and powdered metal and liquid used for temper rolling remain on the surface of the metal sheet. Even in this case, foreign materials and remaining liquid as described above can be washed out by the inlet-side washing device 17, and in addition, the steel sheet can be dried by the inlet-side forced drying device 16. Accordingly, since the solid particles do not tightly adhere to the metal sheet which passed through the blast chamber 2, decrease in yield of the solid particles is not generated, and maldetection will not be made by a surface state detector provided at the downstream side.

In this embodiment, a method for jetting water to a steel sheet is used in the inlet-side washing device 17, and water is circulated for reuse. However, when oil components adhere to the metal sheet 1, washing water containing a washing agent may be used. In addition, when a large amount of oil components such as rolling oil adheres to the metal sheet 1, an alkaline degreasing device may be disposed.

In addition, the inlet-side forced drying device 16 is a device for drying the metal sheet using a hot-air drier, and moisture adhering to the metal sheet caused by the inlet-side washing device 17 is evaporated.

At the inlet side of the blasting device performing blasting onto the top surface of the metal sheet, gas jet devices 50 are provided in the blast chamber 2 for blowing off the particles which deposit on the metal sheet. Each gas jet device 50 is formed of a plurality of flat nozzles which are each set so that a jet direction is in the sheet width direction, and when a solenoid valve provided for each nozzle pipe is switched on and off, the flow rate of the jet nozzle can be changed.

At the downstream side of the blast chamber 2 for blasting solid particles having an average particle diameter of 300 μm or less onto the metal sheet which is continuously fed, the cleaner chamber 3*a* is provided which is partitioned from the blast chamber, and in the cleaner chamber 3*a*, the suction device 7*a* for sucking the solid particles is provided. In this case, at the downstream side of the cleaner chamber 3*a*, the brush particle removing device 27 formed of the brush roll and the suction duct is provided. Furthermore, at the downstream side thereof, the adhesive-roll particle removing device 28 is provided in which the adhesive rolls having adhesive surfaces are pressed onto the metal sheet.

By blasting the solid particles in the blast chamber 2, a large amount of solid particles is carried into the cleaner chamber 3*a* and is allowed to float in a large space, followed by suction of the solid particles, and hence most of the solid particles are removed from the surface of the metal sheet 1. However, a small amount of the solid particles may remain on the surface of the metal sheet 1 in some cases, and they are to be removed by the brush particle removing device 27. Instead of removing a large amount of the solid particles from the metal sheet, the brush particle removing device 27 is suitably used for totally removing a small amount of remaining particles.

Furthermore, in order to ensure the degree of cleanness of the surface of the metal sheet by totally removing the solid particles, when the adhesive-roll particle removing device 28 is disposed at the downstream side of the brush particle removing device 27, substantially all the solid particles can be removed from the surface of the metal sheet 1.

Figure 10:
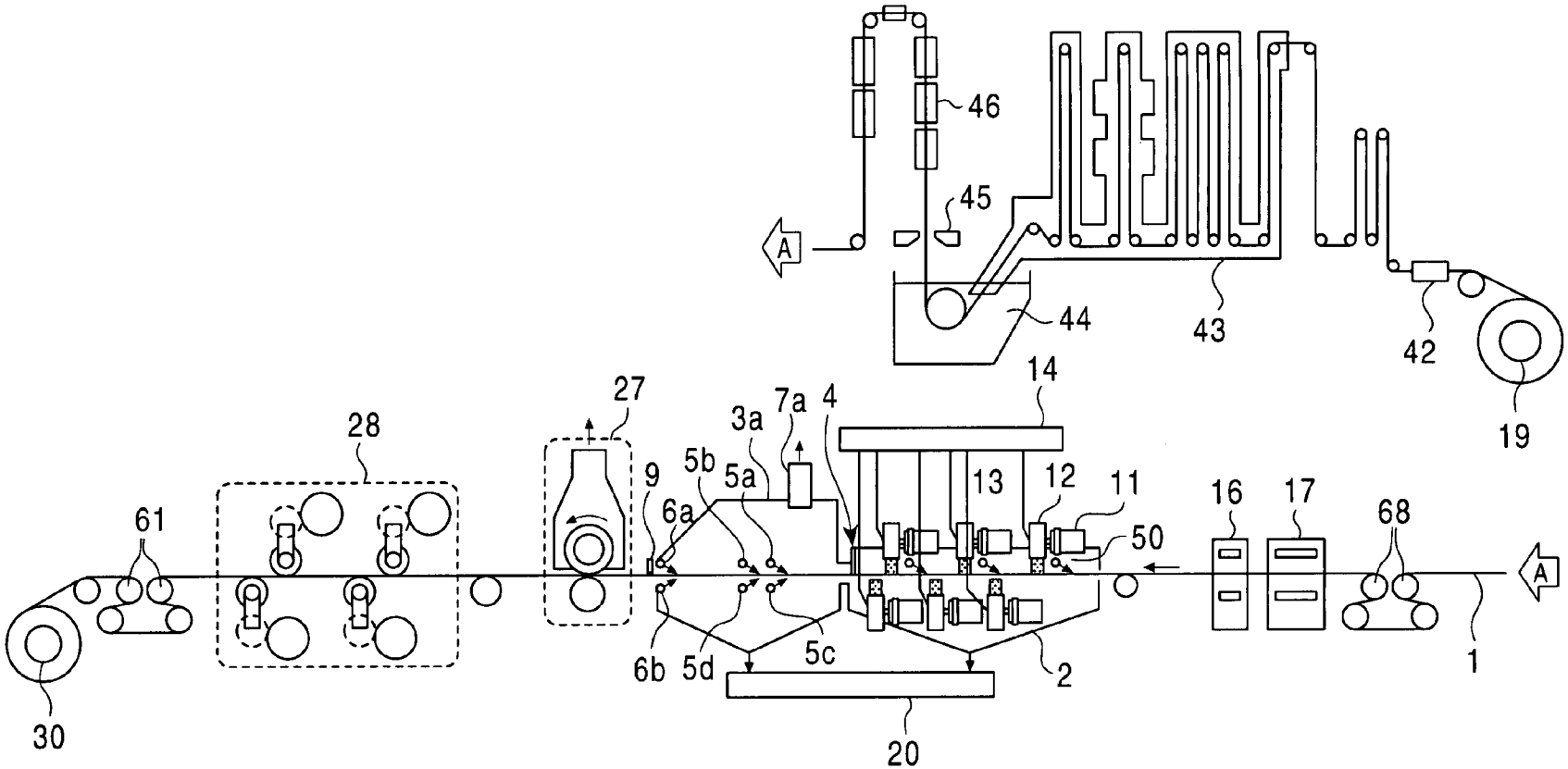
FIG. 10 is a schematic view showing a surface treatment apparatus for a metal sheet, according to embodiment 1-6.

FIG. 10 shows an example of a surface treatment apparatus for a metal sheet disposed in a hot-dip galvanizing line. In the hot-dip galvanizing line, after a steel sheet processed by cold rolling is charged to the payoff reel 19 and is allowed to pass through an inlet-side washing device 42, recrystallization annealing is performed in an annealing furnace 43. Subsequently, after a zinc plating film is formed in a plating bath 44, film-thickness adjustment is performed by an air wiper 45. Next, when an alloyed hot-dip zinc-coated steel sheet is manufactured, an alloying furnace 46 is operated, so that alloying treatment is performed. However, when a zinc plated steel sheet having a film primarily composed of a η layer is manufactured without using the furnace described above, the same line described above is also used for producing.

Figure 11:
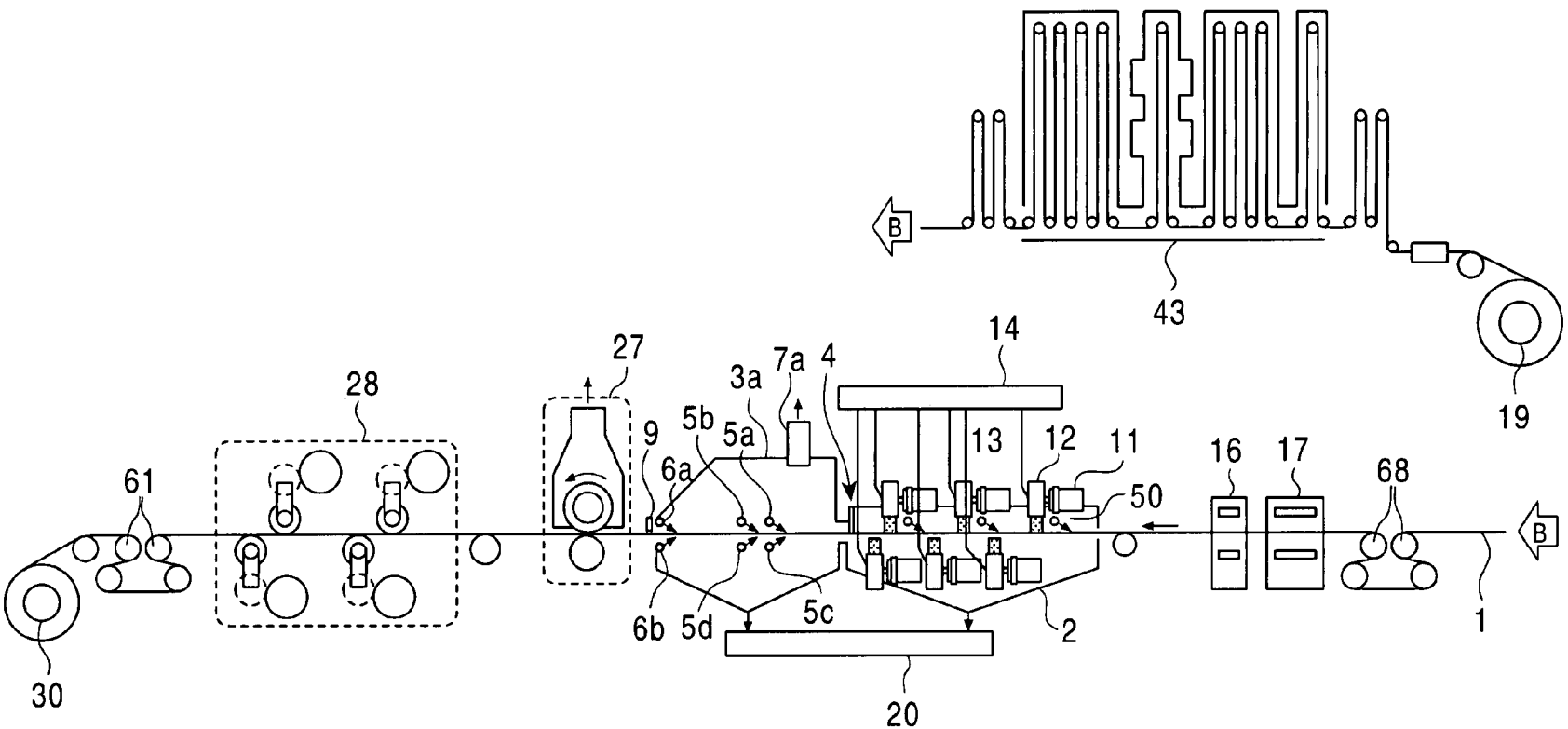
FIG. 11 is a schematic view showing a surface treatment apparatus for a metal sheet, according to embodiment 1-7.

FIG. 11 shows an example of a surface treatment apparatus for a metal sheet disposed in a continuous annealing line having the annealing furnace 43.

Example

The results of the surface roughness formed on a surface of a hot-dip zinc-coated steel sheet by the surface treatment apparatus for a metal sheet, which is provided with a cleaner chamber, shown in FIG. 1 will be described. As the steel sheet on which the surface roughness was formed, a hot-dip zinc-coated steel sheet was used which was composed of a cold-rolled steel sheet having a thickness of 0.8 mm as an under-layer and a plating film primarily made of a η layer, and which was treated by temper rolling after hot dip galvanizing so as to have an elongation rate of 0.8%.

Solid particles which were blasted were solid particles made of SUS 304 having an average particle diameter of 85 μm. These were approximately spherical particles manufactured by an air atomizing method, and by forming dimple-shaped microscopic roughness on the surface of the steel sheet, superior press formability could be obtained.

For blasting the solid particles, a centrifugal rotor blasting device having a vane outside diameter of 330 mm and a maximum rotational speed of 3,900 rpm was used. In this case, the line speed of the steel sheet was set to 50 mpm, and the blast amount was set to 100 kg/min by adjusting a supply device 12 for solid particles.

The cleaner chamber was formed to have a volume of 2 $m^3$ and a distance of 600 mm between the upper portion of the cleaner chamber and the steel sheet. In addition, an outlet portion of the blast chamber 2 had an opening having a height of 140 mm, and at the opening, a rubber curtain having a thickness of 5 mm was disposed so as to be in contact with the steel sheet. In the cleaner chamber, devices for blowing off the solid particles by blower air were disposed, and at an outlet portion of the cleaner chamber, high-pressure air nozzles at a pressure of 0.4 MPa were disposed. In this structure, the height of the opening of the outlet of the cleaner chamber was 140 mm, and at this portion, a rubber curtain was also provided as was the case described above.

In this example, since the amount of solid particles escaping from the cleaner chamber through the opening of the outlet could not be directly measured, the amount of solid particles remaining on the steel sheet which was fed from the outlet of the cleaner chamber was measured, and subsequently the amount of the solid particles escaping therefrom was determined. Accordingly, a tape was fixed on the steel sheet by adhesion, the number of solid particles adhered to the tape was measured, and the number of solid particles per unit area was calculated therefrom.

Figure 8:
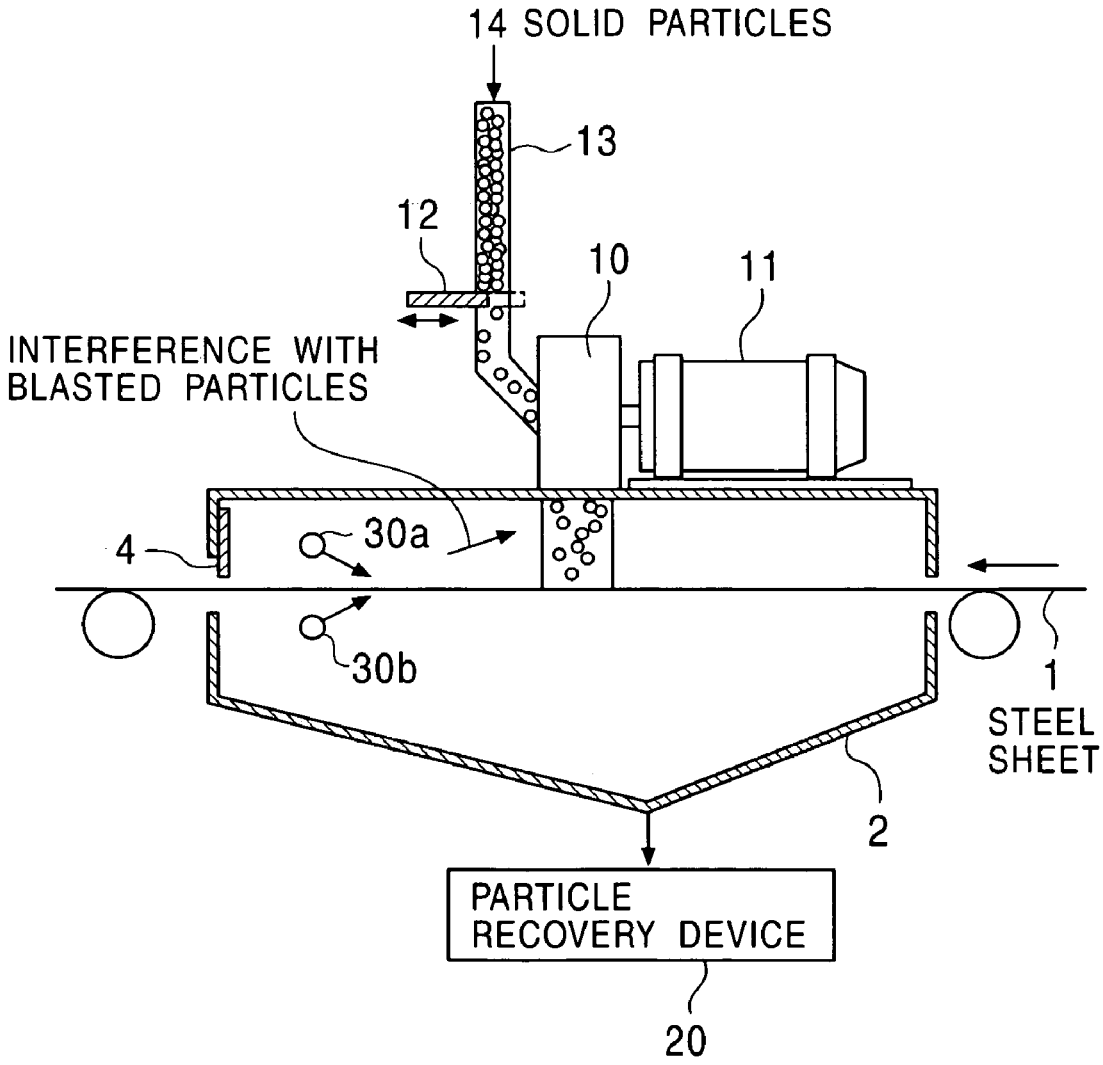
FIG. 8 is a schematic view showing a surface treatment apparatus for a metal sheet, according to a comparative example.

On the other hand, as a comparative example of the present invention, the case of an apparatus structure shown in FIG. 8 was also investigated which had the same blast chamber as that in this example. In this apparatus, high-pressure air nozzles 30*a* and 30*b* were disposed in the blast chamber, and a cleaner chamber was not provided. In this case, the number of solid particles carried out from the blast chamber, which remained on the steel sheet, was obtained by the same method as described above.

As a result, it was found that the number of the remaining solid particles in this example was 5 to 20 pieces/$m^2$, and that in the case of the comparative example, the number of the remaining solid particles was 2,000 pieces/$m^2$. Most of the remaining particles were dispersed to the periphery while being fed in a line and fell from the steel sheet; however, part of the solid particles were caught between the steel sheet and the various rollers disposed in the line, resulting in generation of surface defects. In addition, it is also naturally estimated that the amount of solid particles floating in the air is approximately equivalent to that which deposit on the steel sheet, and when operation is performed for a long period of time, the yield of the solid particles obtained in the apparatus structure according to this example may become largely different from that according to the comparative example.

In the example described above, the effect was verified which was obtained when the brush particle removing device was disposed at the downstream side of the cleaner chamber 3*a* (embodiment 1-3 shown in FIG. 3). The brush roll of the brush particle removing device was a brush roll having an outer diameter of 340 mm, and operation was performed under the conditions wherein the indentation and the rotational speed were 2 mm and 600 rpm, respectively. In addition, the suction duct 23 was connected to the dust collector 24 which was able to suck a flow rate of 150 $m^3$/min.

Under the conditions described above, at the downstream side of the brush particle removing device, the number of the solid particles remaining on the top surface of a steel sheet 1 was measured by the same method as described above. According to the result, although solid particles at a density of 5 to 20 pieces/$m^2$ remained at the outlet side of the cleaner chamber 3*a*, the number of the solid particles became zero at the downstream side of the brush particle removing device; hence, the solid particles were totally removed from the surface of the steel sheet.

When operation is performed for a long period of time, by effects such as abrasion of the brush roll, the solid particles may not be totally removed in some cases; hence, when the adhesive-roll particle removing device is provided at the downstream side of the brush particle removing device, the solid particles can be stably removed from the surface of the steel sheet even when exterior disturbance is present.

Embodiment 2

Figure 12:
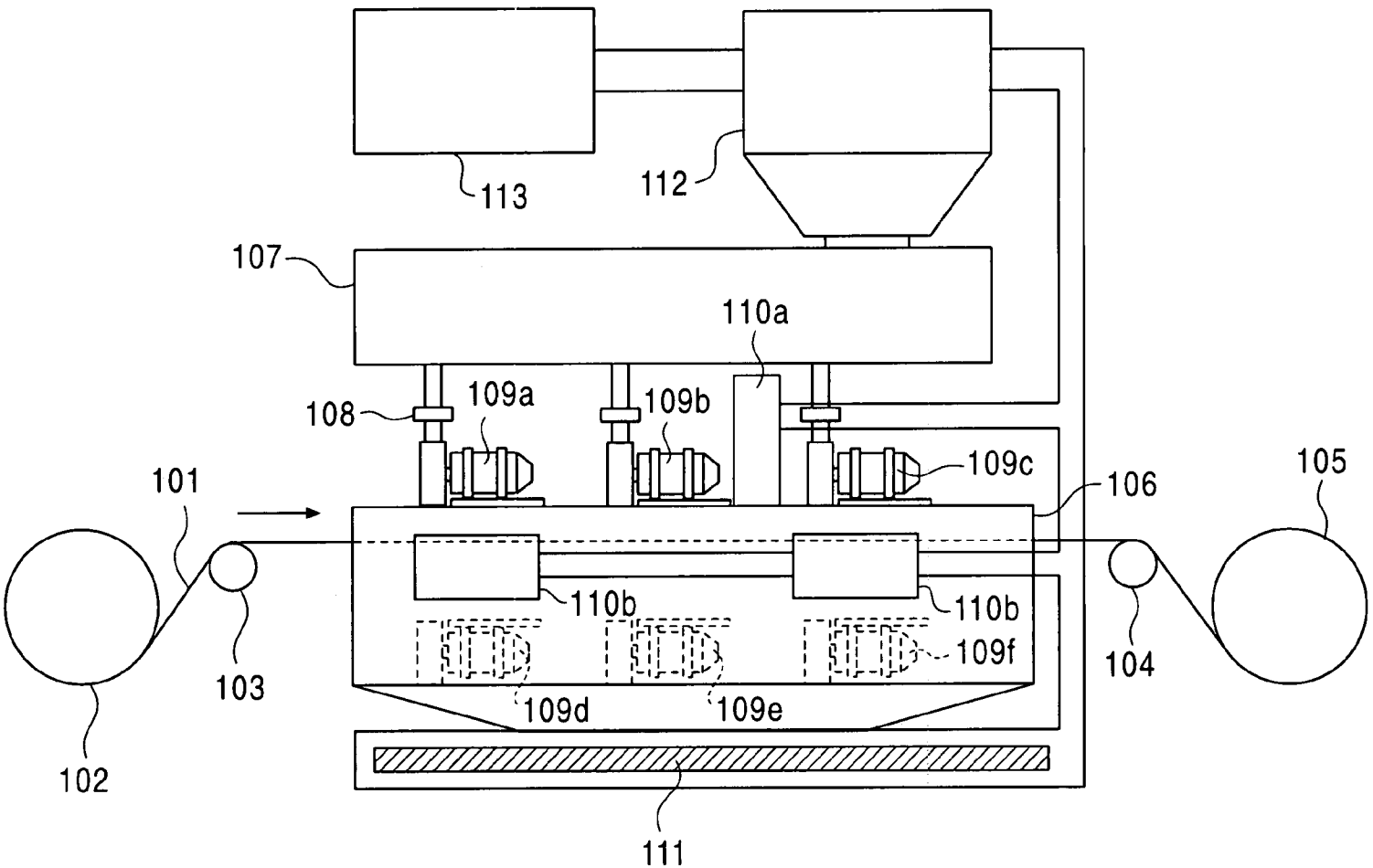
FIG. 12 is a schematic view showing a surface treatment apparatus for a metal sheet, according to embodiment 2.

FIG. 12 is a schematic view showing a surface treatment apparatus for a metal sheet according to embodiment 2. A metal sheet 101 is fed from a payoff reel 102, and based on measurement results of a tension applied to the metal sheet 101 detected by a tension meter 103 and a metal sheet speed detected by a sheet speed meter 104, the metal sheet is coiled around a tension reel 105 while the tension and speed described above are being controlled to predetermined values. Between the payoff reel 102 and the tension reel 105, a blast chamber 106 is provided, and inside the blast chamber 106, solid particles are blasted onto a surface of the metal sheet 101.

The solid particles are stored in a storage tank 107, and a controlled predetermined amount of solid particles is supplied to a blasting device through a quantitative supply device 108. The quantitative supply device 108 is operated by a gate switching system, and by changing a cross-sectional area of a particle supply pipe, a particle flow rate is controlled. Even when the feed rate of the metal sheet 101 is changed, by changing the particle flow rate, the particle amount blasted per unit area can be controlled to a constant value.

In this embodiment, as the blasting devices, centrifugal rotor blasting devices 109*a* to 109*f* are provided so that three devices are placed at each side of the top and bottom surfaces of the metal sheet and are located at different positions from each other with respect to the sheet width direction and the metal sheet feed direction. In each of these centrifugal rotor blasting devices 109*a* to 109*f*, a rotor having a plurality of vanes (wings) is rotated at a high speed, and the solid particles supplied to the center of the rotor are accelerated by a centrifugal force, thereby blasting the solid particles onto a workpiece. By changing the rotational speed of a motor connected to the rotor, the speed of the blasted particles can be controlled.

At an upper portion and a side portion of the blast chamber 106, suction openings 110*a* and 110*b* are provided, and the solid particles dispersed in the blast chamber are sucked therethrough. In addition, at the lower portion of the blast chamber, a slope having an angle larger than the repose angle of the particles is formed, and the blasted solid particles are collected at the lower portion of the blast chamber and are then recovered by a screw conveyor 111. The solid particles recovered by the screw conveyor 111 and the solid particles sucked through the suction openings 110*a* and 110*b* are fed to a centrifugal classify device 112, and after fine powders and foreign materials are removed, processing is performed by a dust collector 113. In addition, the structure is formed so that solid particles having a predetermined particle diameter, which are obtained by the classification, are returned to the storage tank 107. Accordingly, the surface roughness of the metal sheet 101 can be continuously adjusted by the solid particles thus returned.

Figure 13:
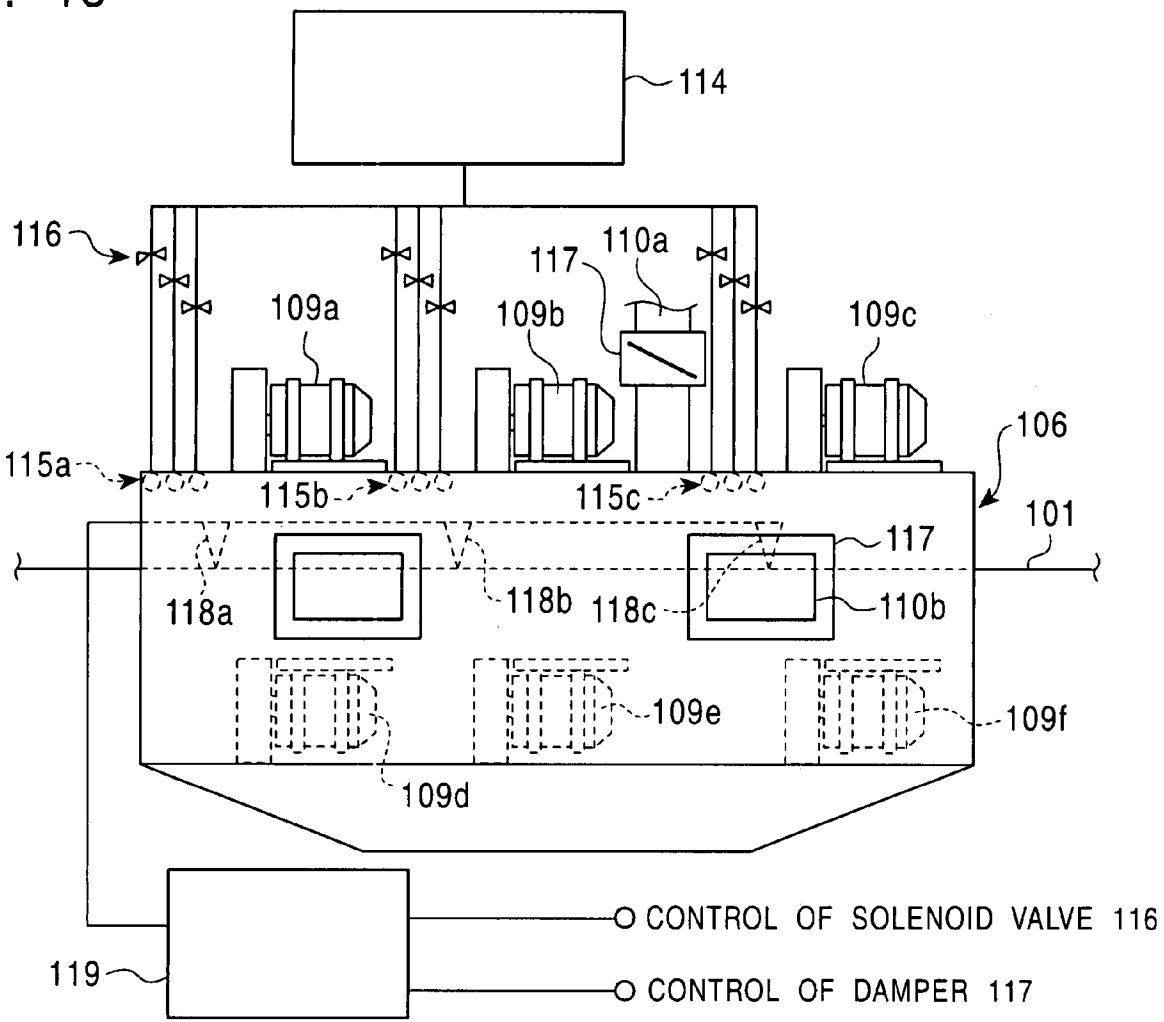
FIG. 13 is a side view showing the structure of a blast chamber of the surface treatment apparatus for a metal sheet shown in FIG. 12.
Figure 14:
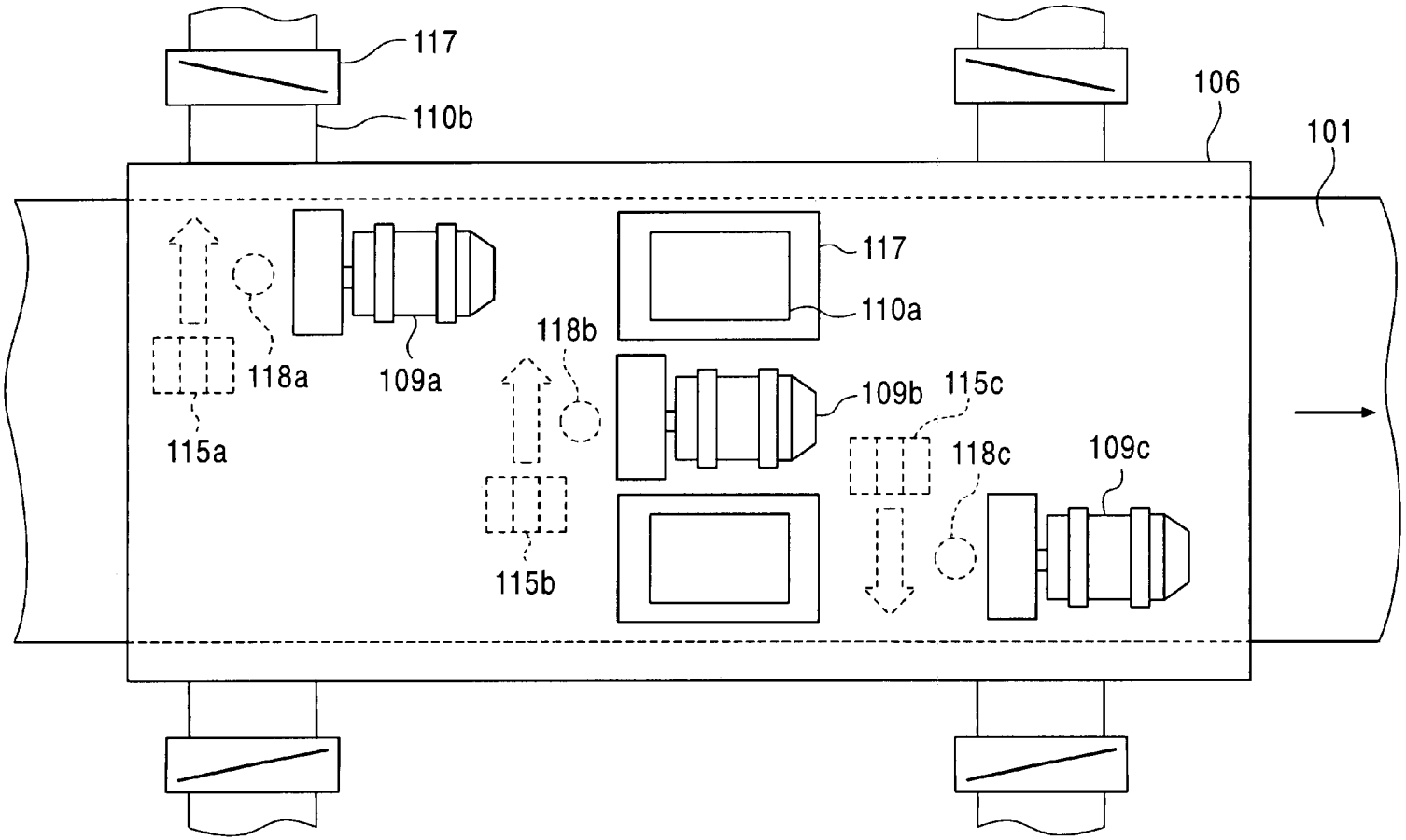
FIG. 14 is a plan view showing the structure of a blast chamber of the surface treatment apparatus for a metal sheet shown in FIG. 12.

FIG. 13 is a side view showing a detailed structure of the blast chamber 106, and FIG. 14 is a plan view thereof. At inlet sides of the centrifugal rotor blasting devices 109*a* to 109*c* performing blasting onto the top surface of the metal sheet, gas jet devices 115*a* to 115*c* plumbed with a compressor 114 are disposed in the blast chamber 106 in order to blow off solid particles which deposit on the metal sheet. Each of the gas jet devices 115*a* to 115*c* is formed of a plurality of flat nozzles each having a jet direction in the sheet width direction, and when a solenoid valve 116 provided in each gas jet device is switched on and off, the flow rate of the jet element can be changed.

The gas jet devices 115*a* to 115*c* are more preferably placed at locations closer to blasting positions of the respective centrifugal rotor blasting devices 109*a* to 109*c*. The reason for this is to prevent as much as possible deposition of dispersed solid particles which occurs before surface formation is performed by the blasting device although the solid particles are removed from the metal sheet by gas jetting beforehand. In addition, it is sufficient when the range in which the solid particles are removed by the gas jet devices 115*a* to 115*c* is the range in which solid particles can be removed which deposit in the width direction region in which the surface roughness is formed by a single blasting device. In addition, since solid particles at the bottom surface fall by gravity and do not deposit on the metal sheet, no gas jet devices are provided in this embodiment. However, when the solid particles may adhere to the bottom surface of the metal sheet by electrostatic charges or the like in some cases, the gas jet devices are preferably provided at the inlet sides of the blasting devices which are located at the bottom surface side.

At the upper portion and the side portion of the blast chamber 106, the suction openings 110*a* and 110*b* are provided which are connected to the dust collector 113 having a suction blower, and the solid particles reflected and dispersed inside the blast chamber are sucked. At each of the suction openings, a damper 117 is provided, and by changing the degree of damper opening, an exhaust flow rate can be changed.

In addition, at the inlet sides of the individual centrifugal rotor blasting devices 109*a* to 109*c*, light-receiving sensors 118*a* to 118*c* are provided, each of which is formed of a light source and a detector detecting the intensity of reflected light. The output of the light-receiving sensor is normalized by the intensity of reflected light in the state in which no particles deposit on the metal sheet, and when the intensity of reflected light is decreased, switching control of the solenoid valves 116 and control of the degree of opening of the dampers 117 are performed by a control computing device 119 so as to increase the flow rates of the gas jet devices 115*a* to 115*c* and the flow rates evacuated from the suction openings 110*a* and 110*b*.

In addition, after air purge is performed, in order to confirm whether the surface of the metal sheet is placed in the normal state, a deposit measurement meter is preferably provided.

The surface treatment apparatus of embodiment 2 described above is provided in a metal sheet producing process, and is used for producing a metal sheet having superior surface properties. For example, at at least one of the upstream side and the downstream side of a temper rolling apparatus provided at a back stage of a producing line of a hot-dipped steel sheet or of a continuous annealing line, the surface treatment apparatus is provided and is used for producing a hot-dipped steel sheet or a cold-rolled steel sheet having superior surface properties. As described above, the surface treatment apparatus of embodiment 2 is preferably used in combination with the temper rolling apparatus; however, in a producing line of a hot-dipped steel sheet or a continuous annealing line, the temper rolling apparatus may only be provided, and the surface treatment apparatus of embodiment 2 may be provided in a separate line so that the surface treatment is performed by batch treatment.

In this embodiment, for example, the hot-dipped steel sheet described above includes a hot-dip zinc-coated steel sheet, an alloyed hot-dip zinc-coated steel sheet, a hot-dip Al—Zn alloy-coated steel sheet, and a hot-dip Zn—Al alloy-coated steel sheet. In addition, the surface properties are properties having influences on the quality of the steel sheet, such as the press formability and the clearness after painting.

Example 1

The results of the surface roughness of a cold-rolled steel sheet having a thickness of 0.8 mm and a width of 1,200 mm are shown, the surface roughness being adjusted using the apparatus having the structure shown in FIG. 12. As solid particles to be blasted, spherical particles made of SUS 304 having an average particle diameter of 85 μm were used. In this experiment, the targeted surface roughness of the steel sheet was set to 1.0 μm as an average surface roughness Ra (JIS B0614). The rotor diameter of the blasting device was 330 mm, and the rotational speed was set to 3,600 rpm. The feed rate of the steel sheet was set to 30 m/min, the blast amount per unit time and per one blasting device was set to 120 kg/min, and blasting was performed under conditions wherein the amount of solid particles blasted per unit area was 10 kg/m$^2$.

Figure 15:
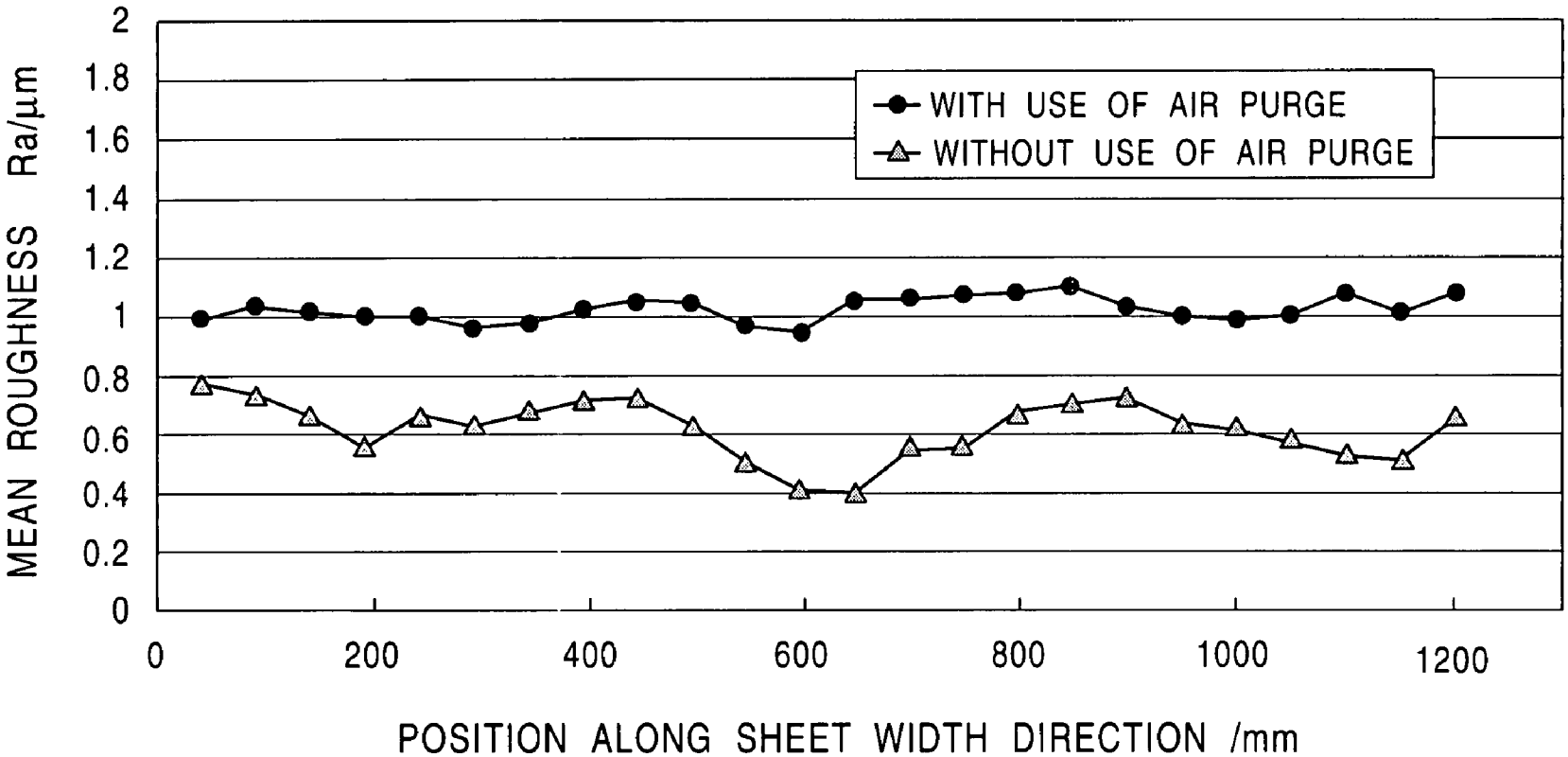
FIG. 15 is a view showing measurement results of the surface roughness of a metal sheet obtained from a comparative example and that obtained from an example of example 1 according to embodiment 2.

Under the conditions described above, steel sheet samples were obtained when the gas jet devices provided at the inlet sides of the blasting devices were used while the steel sheet was being fed and when they were not used. FIG. 15 shows the results of measurement of distribution of the average surface roughness Ra (JIS B0614) along the sheet width direction of the samples described above. The maximum average surface roughness Ra of the steel sheet manufactured without using the gas jet devices was approximately 0.7 μm, and it was found that the roughness largely varied along the sheet width direction. On the other hand, the average surface roughness Ra of the steel sheet manufactured using the gas jet devices was approximately 1.0 μm, and it was found that uniform surface roughness was also formed along the sheet width direction.

According to the results described above, in the case in which the gas jet devices are not used, since the solid particles dispersed inside the blast chamber deposit on the steel sheet, the decrease in surface roughness and the variation thereof occur along the sheet width direction; however, it is understood that when means for removing the solid particles is provided at the inlet side of the blasting device, the uniform surface roughness can be effectively obtained.

Example 2

The results of the surface roughness of a hot-dip zinc-coated steel sheet having a thickness of 0.75 mm and a width of 1,200 mm are shown, the surface roughness being adjusted using the apparatus having the structure shown in FIG. 13. As solid particles to be blasted, spherical particles made of SUS 304 having an average particle diameter of 85 μm were used. The targeted surface roughness of the steel sheet was set to 1.2 μm as the average surface roughness Ra. The rotor diameter of the blasting device was 330 mm, and the rotational speed was set to 3,000 rpm. The feed rate of the steel sheet was accelerated from the start of line operation in the range of from 0 to 50 mpm in a stepwise manner and was decelerated in a stepwise manner before the line stop, and even when the feed rate of the steel sheet was changed, the particle supply amount per unit area was controlled to 5 kg/m$^2$ in accordance with the feed rate by a quantitative supply device.

In addition, in this example, the results of the surface roughness adjustment obtained from two cases were compared to each other. One of the cases (example A) was that the adjustment of surface roughness was performed by switching of the solenoid valves and controlling the degree of opening of the dampers using the light-receiving sensors detecting reflected light emitted from light sources provided at the inlet sides of the blasting devices so that when the intensity of the reflected light was decreased, the flow rate of air jetted from each gas jet nozzle and the flow rate evacuated from each suction opening were increased in proportion to the decrease of the intensity of the reflected light. The other case (example B) was that the flow rates of the gas jet nozzles and the flow rates evacuated from the suction openings were set to predetermined values beforehand.

Figure 16A:
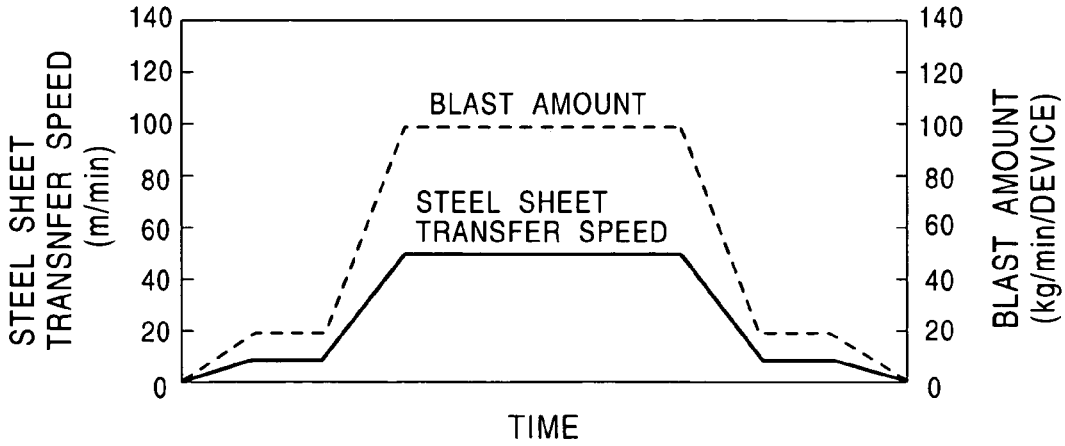
FIG. 16 includes views showing control states of individual devices of example 2 according to embodiment 2.
Figure 16B:
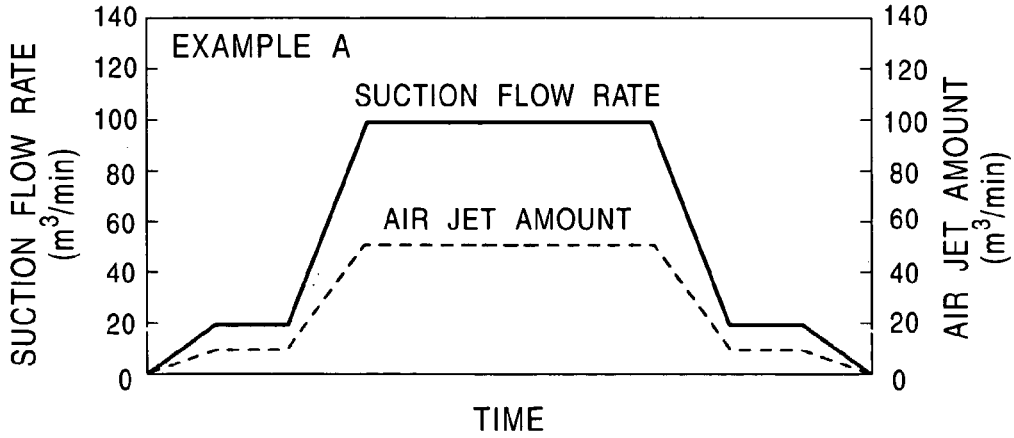
Figure 16C:
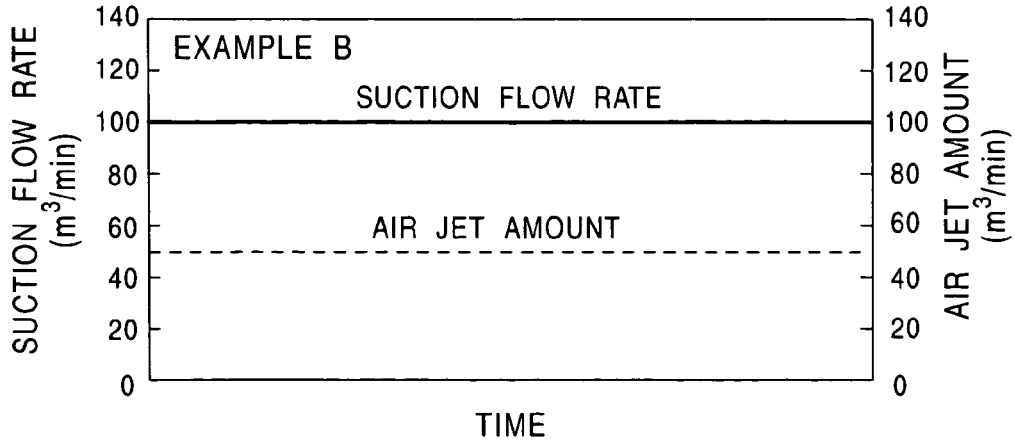

FIG. 16 includes graphs showing the trends with time of the feed rate of the steel sheet, the amount (blast amount) of blasted solid particles per minute and per one blasting device, the air flow rate jetted from the gas jet nozzle unit, and the air flow rate evacuated from the suction opening. In example A, even when the feed rate of the steel sheet was changed, the air flow rate was controlled to a minimum value at which the reflectance calculated from the intensity of the reflected light detected by the light-receiving sensor was 0.9 or more. On the other hand, in example B, operation was always performed with a large air flow rate.

Figure 17:
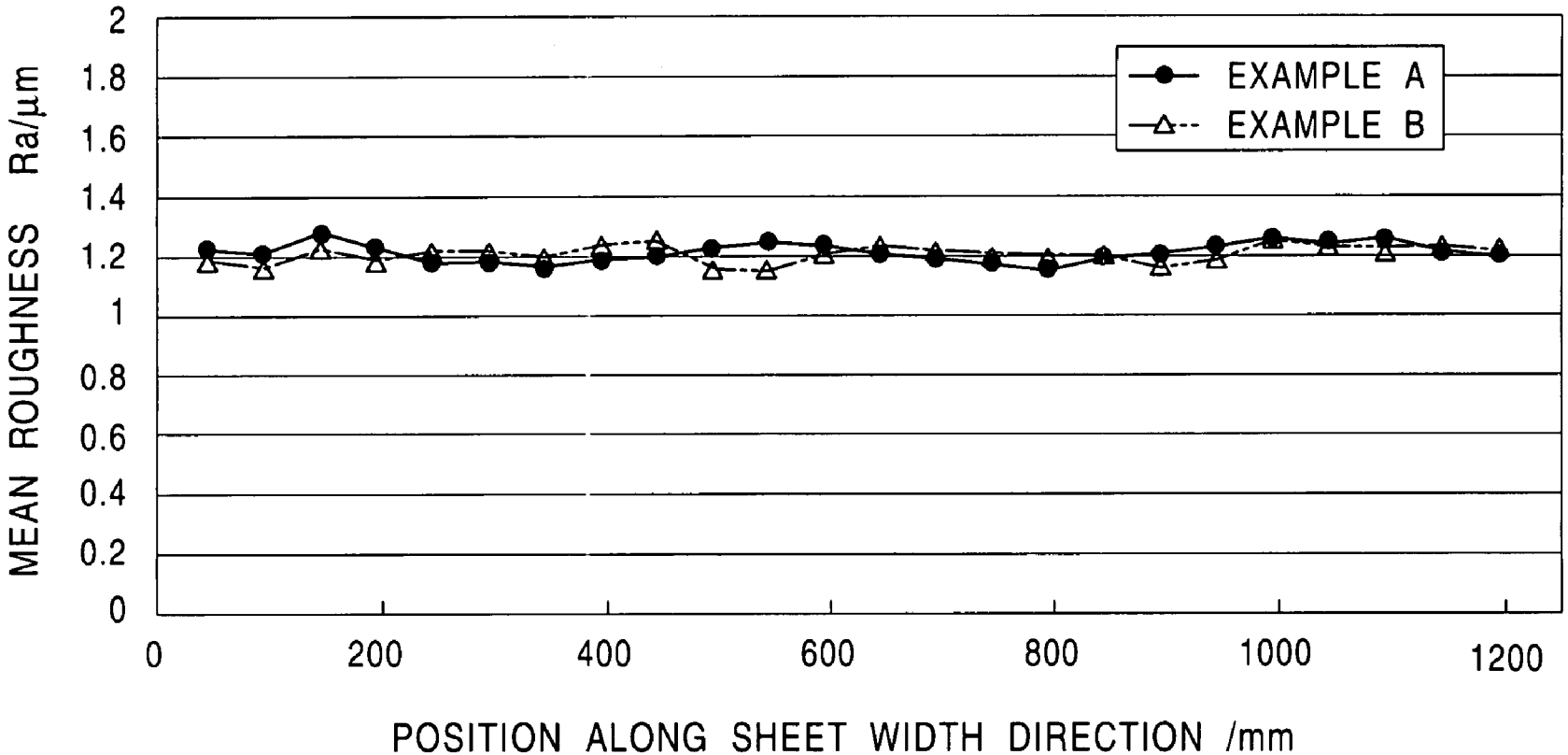
FIG. 17 is a view showing measurement results of the surface roughness of individual steel sheets of example 2 according to embodiment 2.

FIG. 17 shows the measurement results of distribution of the average surface roughness Ra along the sheet width direction of samples in examples A and B obtained in the range in which the steel sheet feed rate was accelerated. It was found that, in example A in which the air flow rate was controlled to be small, uniform surface roughness along the width direction was ensured. That is, by controlling the air flow rate using the sensor measuring the intensity of the reflected light, even when a small air flow rate is used, a desired surface roughness can be obtained and hence running cost can be decreased.

Embodiment 3

Figure 18:
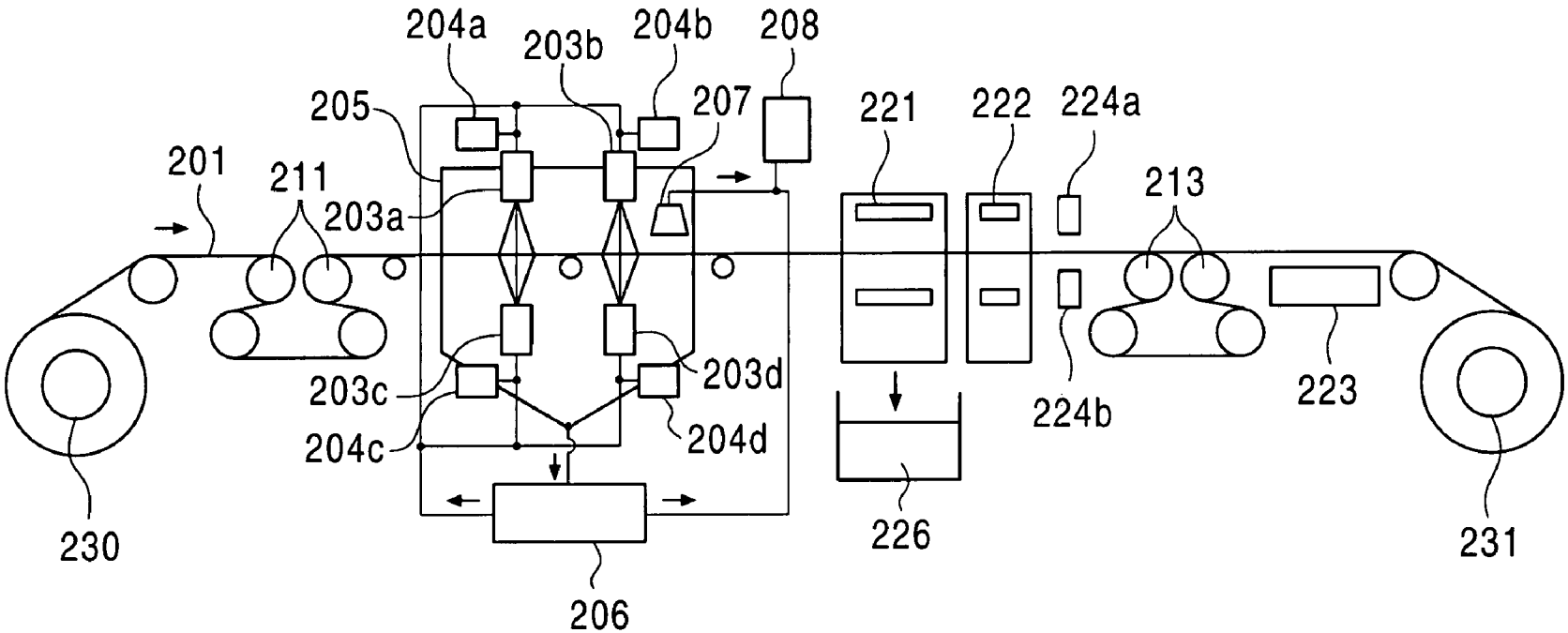
FIG. 18 is a schematic view showing a surface treatment apparatus for a metal sheet, according to embodiment 3-1.

FIG. 18 is a view showing an example of embodiment 3-1, in which the configuration is shown for adjusting the surface roughness in a blast chamber 205 while a metal sheet 201 is continuously fed. As the metal sheet 201, a cold-rolled steel sheet or a hot-dip zinc-coated steel sheet is generally used, and when a cold-rolled steel sheet is used, a steel sheet is preferably used which is processed by temper rolling after cold rolling and continuous annealing so that the mechanical properties are adjusted. In addition, when the surface roughness is formed on a hot-dip steel sheet, a steel sheet is preferably used which is obtained by the steps of cold rolling, annealing, and zinc plating, followed by temper rolling. However, before temper rolling is performed, the steel sheet may be allowed to pass through this line for forming the surface roughness, followed by temper rolling. In addition, the metal sheet 201 is not limited to a cold-rolled steel sheet and a hot-dip zinc-coated steel sheet, and for example, another surface-treated steel sheet may also be used.

In the apparatus shown in FIG. 18, the metal sheet as described above is charged to a payoff reel 230 and is coiled around a tension reel 231. In this step, while a tension is applied to the metal sheet between an inlet-side bridle roll 211 and an outlet-side bridle roll 213, the metal sheet 201 is continuously fed.

Figure 25:
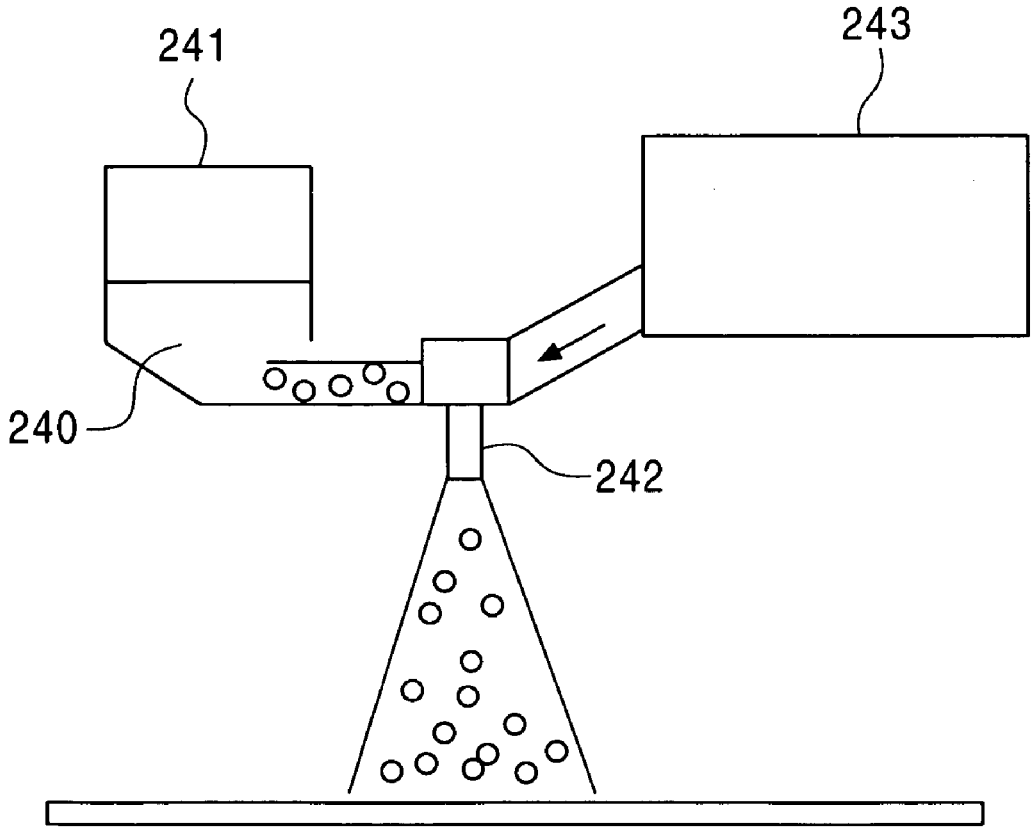
FIG. 25 is a view showing a schematic structure of a pneumatic blasting device.
Figure 26:
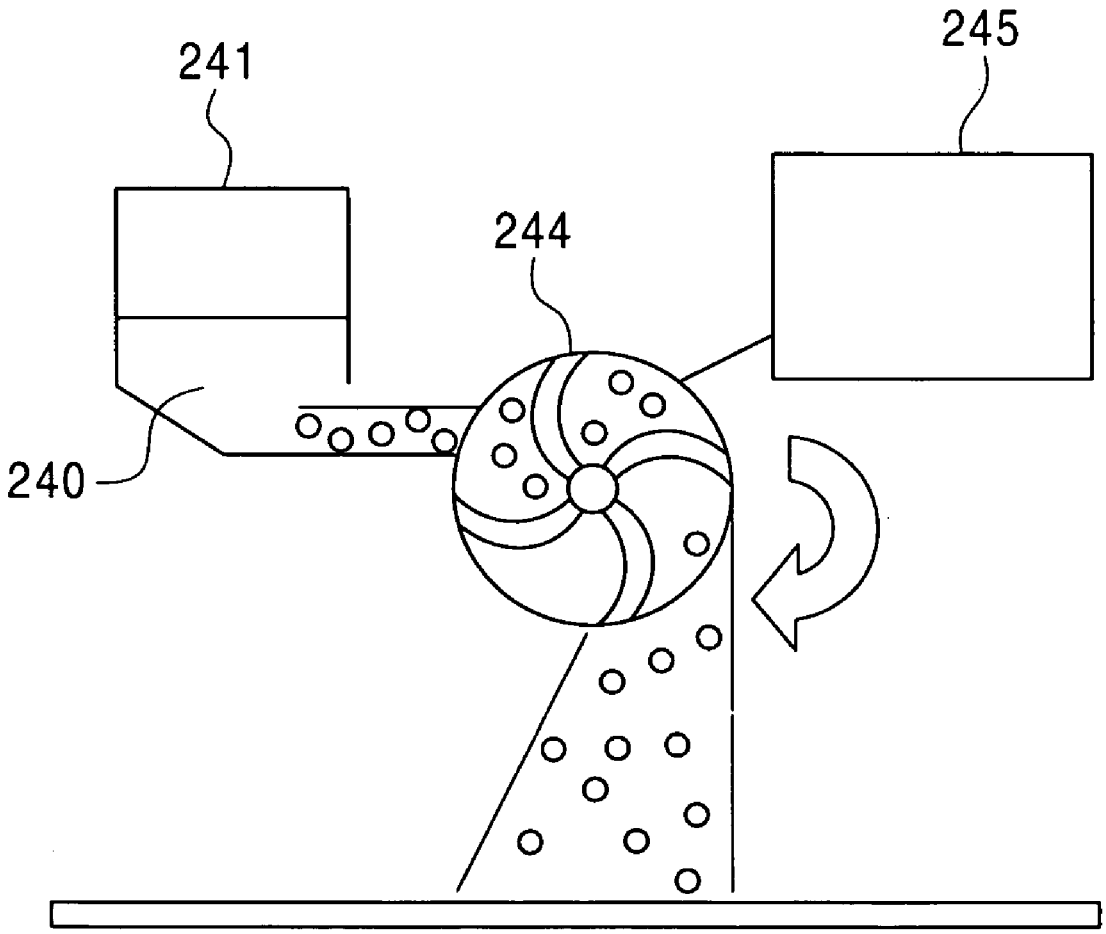
FIG. 26 is a view showing a schematic structure of a centrifugal rotor blasting device.

The blast chamber 205 is formed of a chamber and blasting devices 203*a*, 203*b*, 203*c*, and 203*d*. Inside the blast chamber, the blasting devices 203*a*, 203*b*, 203*c*, and 203*d* are disposed for blasting solid particles onto the front and the rear surfaces of the metal sheet, and a predetermined amount of the solid particles is supplied from a solid particle supply device 206. As a type of blasting device, a pneumatic blasting device shown in FIG. 25 or a centrifugal rotor blasting device shown in FIG. 26 may be used.

In the pneumatic blasting device, solid particles 240 are stored in a hopper 241, and air compressed by a compressor 243 is supplied to a blast nozzle 242. In the blast nozzle, the compressed air is accelerated and jetted to the metal sheet together with the solid particles 241 which are also accelerated.

On the other hand, in the centrifugal rotor blasting device, the solid particles 240 are stored in the hopper 241, and impellers 244 are rotated by a motor 245. The solid particles 240 are accelerated by a centrifugal force generated by the impellors and are then blasted onto the metal sheet.

In the case of the pneumatic blasting device, the solid particles can be much accelerated even when the average particle diameter thereof is small; however, since a blasting area is difficult to increase, a plurality of blast nozzles must be disposed in the sheet width direction or in the longitudinal direction of the metal sheet. On the other hand, in the case of the centrifugal rotor blasting device, energy efficiency is high, and the blasting area can be increased; however, the speed of the solid particles is small as compared to that by the pneumatic blasting device. However, when the particle diameter of the solid particles is 30 μm or more, even by the centrifugal rotor blasting device, a blast speed can be obtained which is sufficient for adjusting the surface roughness of a cold-rolled steel sheet or a zinc-plated steel sheet.

The blasting devices 203*a*, 203*b*, 203*c*, and 203*d* shown in FIG. 18 each indicate the centrifugal rotor blasting device, and the solid particles supplied from the supply device 206 of the solid particles are fed to the impellers which are rotated by motors 204*a* to 204*d* and are then accelerated and blasted by the blasting devices 203*a* to 203*d* onto the metal sheet 201. In the centrifugal rotor blasting device, by changing the rotational speed of the impellers or the supply amount of the solid particles supplied from the supply device 206, the blast speed and the blast amount of the solid particles can be changed. In addition, a plurality of blasting devices 203*a*, 203*b*, 203*c*, and

203*d* must be disposed so as to have a uniform blast density along the width direction of the steel sheet.

FIG. 18 shows two lines of blast nozzles, which are disposed at each of the front and the rear surfaces; however, in the feed direction of the steel sheet, one blast nozzle or a plurality of blast nozzles is disposed in accordance with the line speed so that the steel sheet obtains a blast density controlled in a predetermined range. However, it is not always necessary to blast the solid particles onto the front and the rear surfaces, and in accordance with application, blasting may only be performed onto one surface.

Inside the blast chamber 205, the solid particles blasted onto the metal sheet are dispersed to the periphery and are allowed to float; however, they are sucked to the lower portion of the blast chamber and are again fed to the supply device 206 for the reuse by circulation. In general, the supply device 206 of the solid particles is provided with a separator, and powdered zinc mixed with the solid particles and pulverized fine solid particles are separated and fed to a dust collector 208. Accordingly, the change in average particle diameter of the solid particles with time can be prevented, and the condition of the solid particles can be maintained at a predetermined level.

In addition, in the blast chamber, fine particles which are not sucked to the lower portion and which are allowed to float are collected by a cleaner blower 207 and are then processed by the dust collector 208. However, when the average particle diameter of the solid particles is small, such as 300 μm or less, the solid particles cannot be totally prevented from escaping outside the blast chamber with an accompanying flow generated by the continuous feed of the metal sheet from the blast chamber.

Furthermore, in embodiment 3-1, in order to adjust the surface structure of a zinc-plated steel sheet, a measurement device for measuring the surface structure is disposed at the downstream side of the bridle roll 213, and based on the measurement result, the blast speed and the blast amount of the solid particles may be changed. As the measurement device for the surface structure, for example, there may be mentioned a device for measuring the average surface roughness Ra or a peak count PPI or a device which takes a picture of the surface of the steel sheet using a CCD camera or the like and then determines the size of dents formed by the solid particles using image processing.

In embodiment 3-1 shown in FIG. 18, at the downstream side of the blast chamber 205, a washing device 221 for the metal sheet and an outlet-side forced drying device 222 are continuously disposed, and this embodiment is characterized in that solid particles remaining on the metal sheet are not removed by air wiping or the like from the blast chamber to the outlet-side washing device 221.

In the outlet-side washing device 221, a method for jetting water to a metal sheet is used. As the flow rate of washing water, a flow rate to wash out solid particles present on the metal sheet may be sufficient. However, since the efficiency of removing the solid particles is improved by jetting pressurized water to the metal sheet, it may be sufficient when pressurized water having a pressure of 10 kgf/cm$^2$ or less is used. In addition, in order to improve the effect of washing out the solid particles, it is also effective to add a surfactant to the washing water.

At the lower side of the outlet-side washing device 221, a waste fluid pit 226 is disposed, and the solid particles are separated and recovered by a liquid cyclone or the like. Since the solid particles recovered as described above contain moisture, after being dried, the solid particles are supplied to a particle circulation system of the blast chamber 205. Hence, the problem in that the yield of the solid particles is decreased since the particles are carried out from the blast chamber can be solved.

In addition, the outlet-side forced drying device 222 is a device for drying the metal sheet using a hot-air dryer, and moisture adhering to the metal sheet in the outlet-side washing device 221 is evaporated. However, when the whole moisture remaining on the steel sheet right after washing is removed by the hot-air dryer, a device having a large capacity is required, and hence an air wiper capable of performing air wiping which jets compressed air to the metal sheet is preferably disposed between the outlet-side washing device 221 and the outlet-side forced drying device 222. By this configuration, most of the moisture can be removed from the metal sheet, and in addition, further remaining moisture may be evaporated by the outlet-side forced drying device 222.

Furthermore, at the downstream side of the outlet-side forced drying device 222, gas wipers 224*a* and 224*b* capable of performing gas wiping which jets compressed air to the metal sheet are provided. By this configuration, compressed air may be jetted to the entire surface of the metal sheet; however, with respect to the periphery of the sheet edge portions of the metal sheet, it may be sufficient when gas jet nozzles are disposed so that the gas flow is in the direction from the central portion of the metal sheet to the sheet edge portions thereof. In particular, a small amount of solid particles can be easily removed which are trapped together with a washing liquid in minute cracks generated at the sheet edge portions, and hence the degree of cleanness of the metal sheet is improved.

Figure 19:
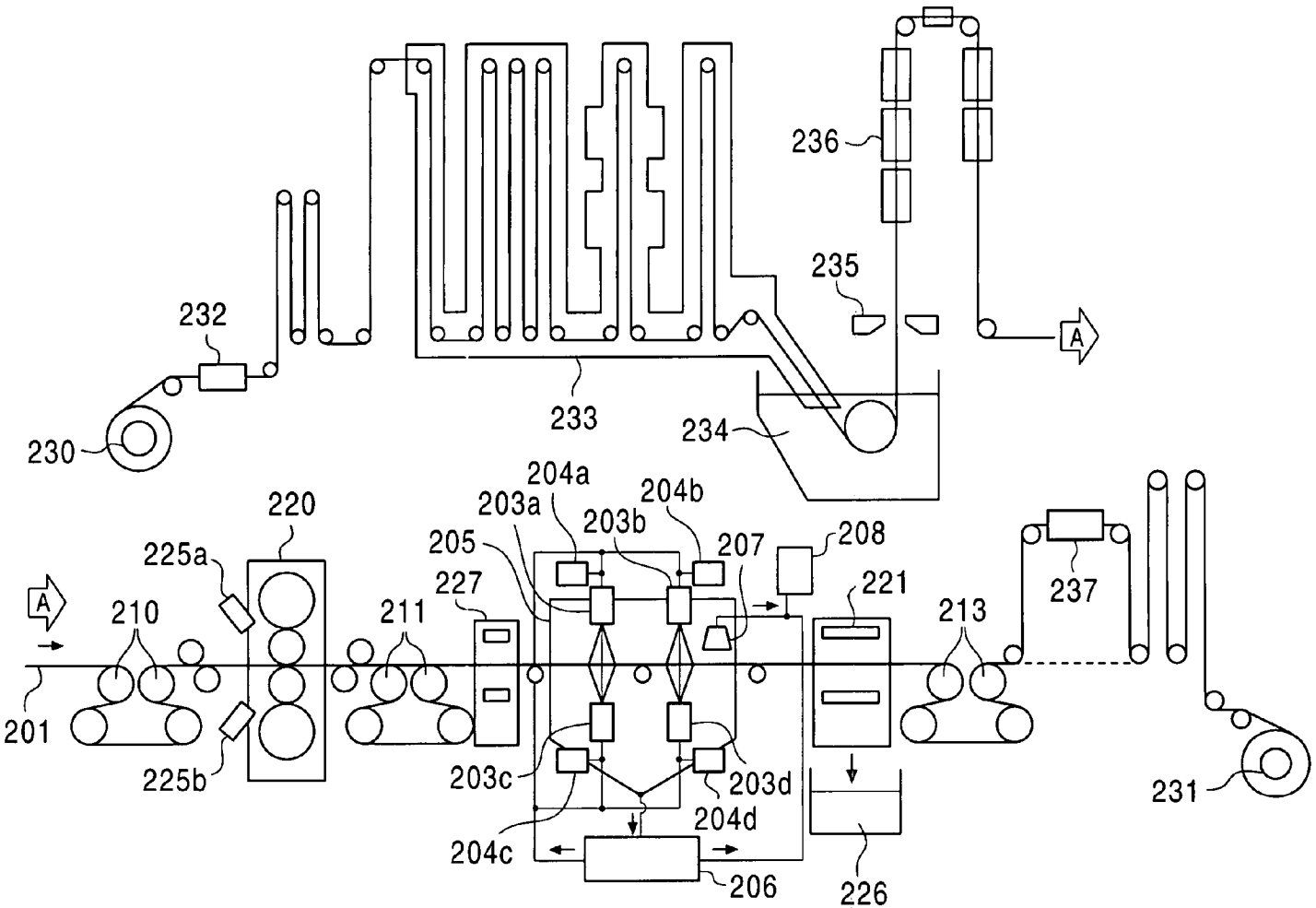
FIG. 19 is a schematic view showing a surface treatment apparatus for a metal sheet, according to embodiment 3-2.

FIG. 19 is a view showing an example of embodiment 3-2, and in this example, a temper rolling apparatus 220 is disposed at the downstream side of a plating bath 234 of a hot-dip galvanizing line; nozzles 225*a* and 225*b* jetting water are disposed at the inlet side of the temper rolling apparatus; an inlet-side forced drying device 227 is disposed at the downstream side of the nozzles; and at the downstream side of the forced drying device, the blast chamber 205 and the outlet-side washing device 221 are disposed. In the following figures, the same reference numerals assigned to the constituent elements shown in the figures described above designate the same constituent elements, and description of detailed movements of the constituent elements may be omitted in some cases. The constituent elements having the same reference numeral have the same movement and the same effect in the embodiments.

In the hot-dip galvanizing line, after a steel sheet processed by cold rolling is charged to the payoff reel 230 and is then allowed to pass through an inlet-side washing device 232, recrystallization annealing is performed in an annealing furnace 233. Subsequently, after a zinc plating film is formed in the plating bath 234, film-thickness adjustment is performed by an air wiper 235. Next, in the case in which an alloyed hot-dip zinc-coated steel sheet is manufactured, an alloying furnace 236 is operated, thereby performing alloying treatment. However, when a zinc plated steel sheet having a film primarily composed of a η layer is manufactured without using the furnace described above, the same line described above is also used for producing.

In a general hot-dip galvanizing line, the following two cases are performed after temper rolling is carried out by the temper rolling apparatus 220. One of the cases is that a chemical conversion coating film is provided by a conversion treatment apparatus 237, and the other case is that a steel sheet is coated with antirust oil and is then coiled together with the oil. On the other hand, in the embodiment shown in FIG. 19, the nozzles 225*a* and 225*b* for jetting water or liquid for temper rolling are disposed at the inlet side of temper rolling, the blast chamber 205 is disposed at the downstream side of the nozzles, and the outlet-side washing device 221 for a steel sheet is further disposed.

In this embodiment, so-called wet temper rolling is performed in which temper rolling is performed while water is being supplied to a steel sheet and rolling rolls in temper rolling. The water supplied onto the steel sheet has an effect of washing out foreign materials such as abraded powders generated in temper rolling; however, when blasted onto the steel sheet in the state described above, the solid particles remain on the steel sheet, and hence a large amount of the solid particles are carried outside, resulting in decrease in yield of the solid particles. Accordingly, it is preferable that the steel sheet be dried beforehand by disposing the inlet-side forced drying device 227 at the upstream side of the blast chamber 205.

In addition, when the steel sheet which passed through the blast chamber 205 is allowed to pass through the outlet-side washing device 221, the solid particles remaining on the surface of the steel sheet can be washed out. The solid particles thus washed out are recovered in the waste fluid pit 226 and are then separated by a liquid cyclone or the like. The solid particles thus recovered are dried and are then supplied to the particle circulation system of the blast chamber 205, and hence the yield is not decreased.

When the configuration is formed as described above, the plating step, the temper rolling for adjusting the mechanical properties of the material, and the blast chamber 205 in which appropriate surface roughness is formed can be disposed on the same line, and hence significant improvement in productivity can be achieved as compared to the batch type apparatus for adjusting the surface roughness shown in FIG. 18.

Figure 20:
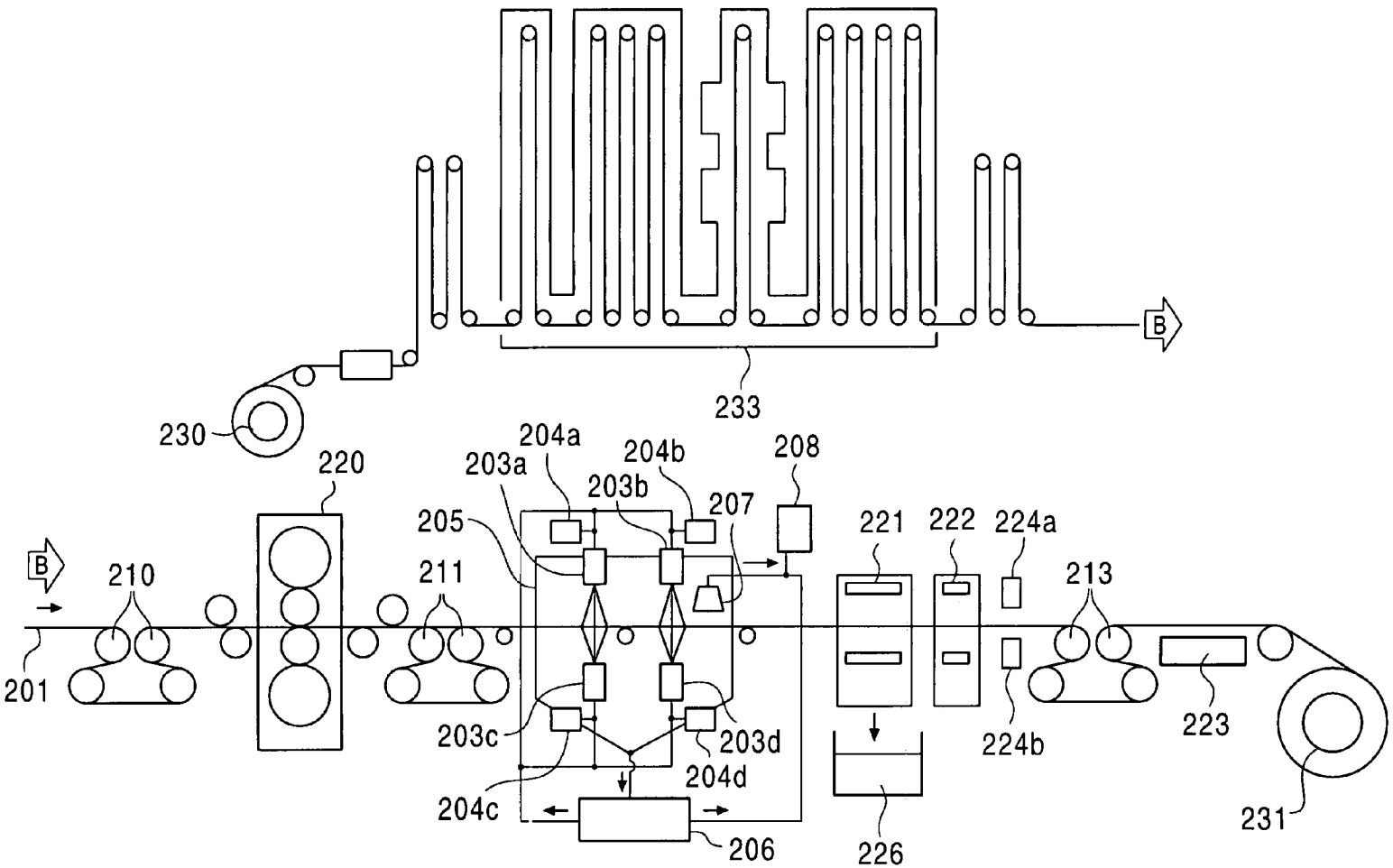
FIG. 20 is a schematic view showing a surface treatment apparatus for a metal sheet, according to embodiment 3-3.

FIG. 20 is a view showing an example of embodiment 3-3. In this example, the configuration is shown in which the temper rolling apparatus 220 is disposed at the downstream side of the annealing furnace 233 of a continuous annealing line, and the blast chamber 205, the outlet-side washing device 221, and the outlet-side forced drying device 222 are continuously disposed at the downstream side of the temper rolling apparatus 220.

In the continuous annealing line, a cold-rolled steel sheet is charged to the payoff reel 230 and is then processed by recrystallization annealing in the annealing furnace 233. In a general continuous annealing line, after temper rolling is performed by the temper rolling apparatus 220, the steel sheet is coated with antirust oil and is then coiled around the tension reel 231. On the other hand, in the embodiment shown in FIG. 20, at the downstream side of the temper rolling apparatus 220, the blast chamber 205, the outlet-side washing device 221, and the outlet-side forced drying device 222 are continuously disposed.

As a temper rolling apparatus disposed in a general continuous annealing line, dry temper rolling performed under dry conditions and wet temper rolling performed under wet conditions may be mentioned, and in FIG. 20, the case of dry temper rolling is shown. In this case, foreign materials such as abraded powders generated in temper rolling remain on the steel sheet, and hence the foreign materials are preferably removed by air wiping beforehand.

When the configuration as described above is formed, the annealing step, the temper rolling for adjusting the mechanical properties of the material, and the blast chamber 205 in which appropriate surface roughness is formed can be disposed on the same line, and hence significant improvement in productivity can be achieved as compared to the batch type apparatus for adjusting the surface roughness shown in FIG. 18.

Figure 21:
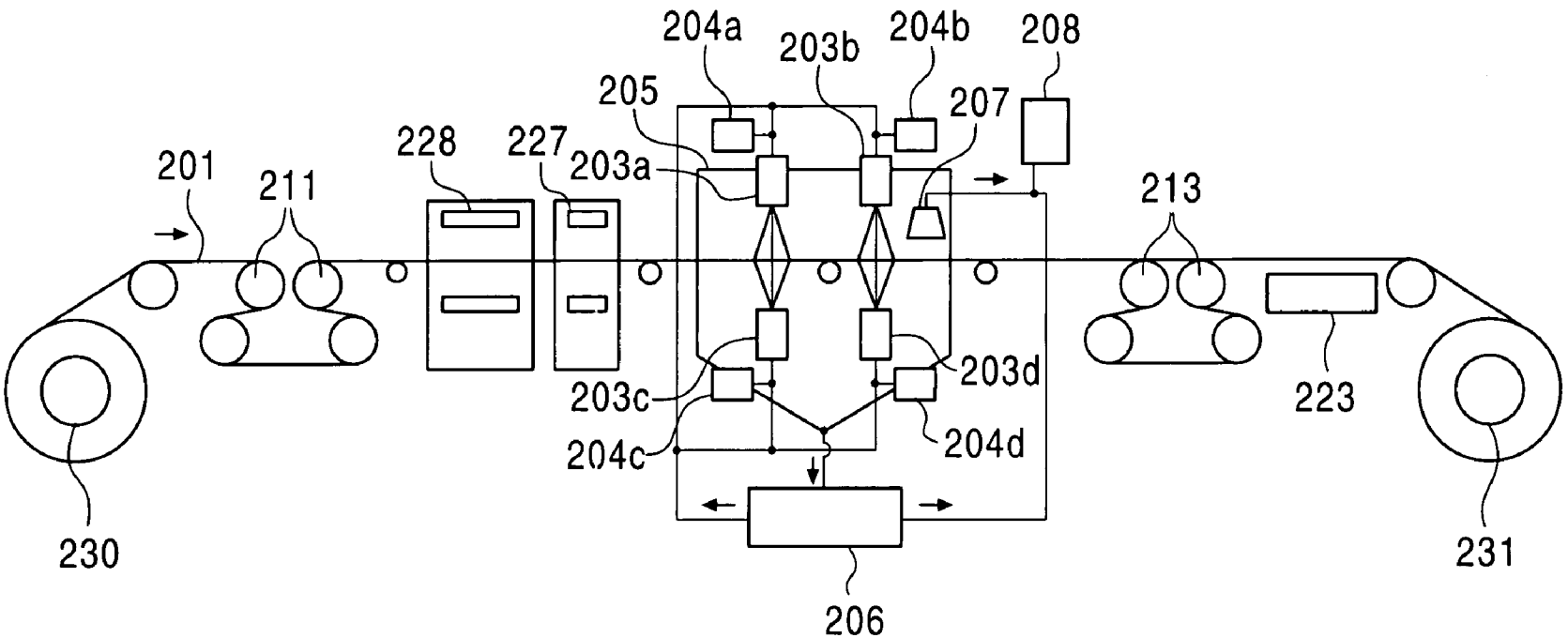
FIG. 21 is a schematic view showing a surface treatment apparatus for a metal sheet, according to embodiment 3-4.

FIG. 21 is a view showing an example of embodiment 3-4. In FIG. 21, the configuration is shown in which the surface roughness is adjusted in the blast chamber 205 while the steel sheet 201 is continuously fed. A cold-rolled steel sheet or a zinc-plated steel sheet is used as the steel sheet 201, and in the case of the cold-rolled steel sheet, a steel sheet is preferably used which is formed by temper rolling following cold rolling and continuous annealing so that the mechanical properties are adjusted. In addition, when the surface roughness is formed on a hot-dip zinc-coated steel sheet, a steel sheet is suitably used which is processed by cold rolling, annealing, and zinc plating, followed by temper rolling. However, before temper rolling is performed, the steel sheet may be allowed to pass through this line for forming the surface roughness, followed by temper rolling. In addition, the steel sheet 201 is not limited to a cold-rolled steel sheet and a hot-dip zinc-coated steel sheet, and another surface-treated steel sheet may also be used.

FIG. 21 shows a method in which the steel sheet as described above is charged to the payoff reel 230 and is coiled around the tension reel 231. In this case, while a tension is being applied to the steel sheet between the inlet-side bridle roll 211 and the outlet-side bridle roll 213, the steel sheet is continuously fed.

The blast chamber 205 is formed of a chamber and the blasting devices 203*a*, 203*b*, 203*c*, and 203*d*. Inside the blast chamber, the blasting devices 203*a*, 203*b*, 203*c*, and 203*d* are disposed for blasting the solid particles onto the front and the rear surfaces of the steel sheet, and a predetermined amount of the solid particles is supplied from the solid particle supply device 206. As a type of blasting device, as described above, the pneumatic blasting device shown in FIG. 25 or the centrifugal rotor blasting device shown in FIG. 26 may be used.

The blasting devices shown in FIG. 21 each indicate the centrifugal rotor blasting device, and the solid particles supplied from the supply device 206 of the solid particles are fed to the impellers to be rotated by the motors 204*a* to 204*d* and are then accelerated and blasted onto the steel sheet 201 by the blasting devices 203*a* to 203*d*. In the centrifugal rotor blasting device, by changing the rotational speed of the impellors or the supply amount of the solid particles supplied from the supply device 206, the blast speed and the blast amount of the solid particles can be changed. In addition, a plurality of blasting devices 203*a*, 203*b*, 203*c*, and 203*d* must be disposed so as to have a uniform blast density along the width direction of the steel sheet. FIG. 21 shows two lines of blast nozzles, which are disposed at each of the front and the rear surfaces; however, in the feed direction of the steel sheet, one blast nozzle or a plurality of blast nozzles is disposed in accordance with the line speed so that the steel sheet obtains a blast density controlled in a predetermined range. However, it is not always necessary to blast the solid particles onto the front and the rear surfaces, and in accordance with application, blasting may be only performed onto one surface.

Inside the blast chamber 205, after being dispersed to the periphery and being allowed to float, the solid particles blasted onto the steel sheet are sucked to the lower portion of a blast chamber and are again fed to the supply device 206 for the reuse by circulation. In general, the supply device 206 of the solid particles is provided with a separator, and powdered zinc mixed with the solid particles and pulverized fine solid particles are separated and fed to the dust collector 208. Accordingly, the change in average particle diameter of the solid particles with time can be prevented, and the condition of the solid particles can be maintained at a predetermined level. In addition, in the blast chamber, fine particles which are not sucked to the lower portion of the blast chamber and are allowed to float are collected by the cleaner blower 207 and are then processed by the dust collector 208.

Furthermore, in embodiment 3, in order to adjust the surface structure of a zinc-plated steel sheet, a measurement device for measuring the surface structure is disposed at the downstream side of the bridle roll 213, and based on the measurement result, the blast speed and the blast amount of the solid particles may be changed. As the measurement device, for example, there may be mentioned a device for measuring the average surface roughness Ra or the peak count PPI or a device which takes a picture of the surface of the steel sheet using a CCD camera or the like and then determines the size of dents formed by the solid particles using image processing.

In embodiment 3-4 shown in FIG. 21, at the upstream side of the blast chamber 205, the inlet-side forced drying device 227 and an inlet-side washing device 228 for the steel sheet are continuously disposed. The steel sheet to be charged to the payoff reel 230 is a steel sheet processed by temper rolling or the like in a preceding step, and powdered metal and liquid used for temper rolling remain on the surface of the steel sheet. Even in this case, foreign materials and remaining liquid can be washed out by the inlet-side washing device 228, and in addition, the steel sheet can be dried by the inlet-side forced drying device 227. Accordingly, since the solid particles do not tightly adhere to the steel sheet which passed through the blast chamber 205, decrease in yield of the solid particles does not occur, and maldetection will not be made by the measurement device for the surface structure provided at the downstream side.

In this embodiment, in the inlet-side washing device 228, a method for jetting water to a steel sheet is used, and water is circulated for reuse. However, when oil components adhere to the steel sheet 201, washing water containing a washing agent may be used. In addition, when a large amount of oil components such as rolling oil adheres to the steel sheet 201, an alkaline degreasing device may be disposed.

In addition, the inlet-side forced drying device 227 is a device for drying the steel sheet with a hot-air drier, and moisture adhering to the steel sheet in the inlet-side washing device 228 is evaporated. However, when the whole moisture remaining on the steel sheet right after washing is removed by the hot-air dryer, a device having a large capacity is required, and hence an air wiper capable of air-wiping which jets compressed air to the metal sheet is preferably disposed between the inlet-side washing device 228 and the inlet-side forced drying device 227. By this configuration, most of the moisture can be removed from the metal sheet, and in addition, further remaining moisture may be evaporated by the inlet-side forced drying device 228.

Figure 22:
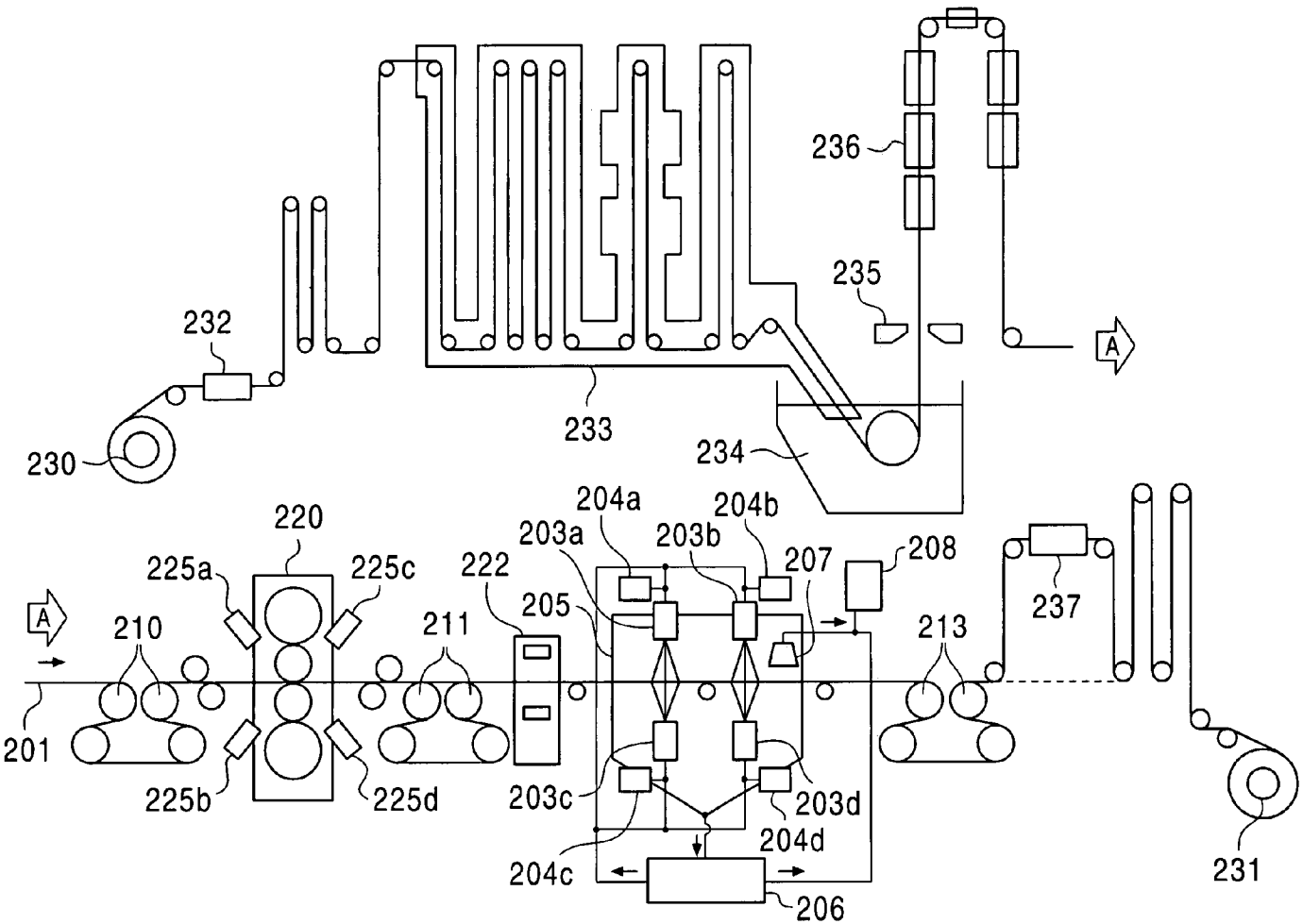
FIG. 22 is a schematic view showing a surface treatment apparatus for a metal sheet, according to embodiment 3-5.

FIG. 22 is a view showing an example of embodiment 3-5, and in this example, the configuration is shown in which the temper rolling apparatus 220 is disposed at the downstream side of the plating bath 234 of the hot-dip galvanizing line; nozzles 225*a* to 225*d* jetting water are disposed at the inlet side and the outlet side of the temper rolling apparatus; and the inlet-side forced drying device 227 and the blast chamber 205 are disposed at the downstream side of the nozzles. In the hot-dip galvanizing line, after a steel sheet processed by cold rolling is charged to the payoff reel 230 and is then allowed to pass through the inlet-side washing device 232, recrystallization annealing is performed in the annealing furnace 233. Subsequently, after a zinc plating film is formed in the plating bath 234, film-thickness adjustment is performed by the air wiper 235. Next, in the case in which an alloyed hot-dip zinc-coated steel sheet is manufactured, the alloying furnace 236 is operated, thereby performing alloying treatment. However, when a zinc plated steel sheet having a film primarily composed of a n layer is manufactured without using the furnace described above, the same line described above is also used for producing.

In a general hot-dip galvanizing line, the following two cases are performed after temper rolling is carried out by the temper rolling apparatus 220. One of the cases is that a chemical conversion film is provided by the conversion treatment apparatus 237, and the other case is that a steel sheet is coated with antirust oil and is then coiled together with the oil. On the other hand, in the embodiment shown in FIG. 22, the nozzles 225*a* to 225*d* for jetting water or liquid for temper rolling are disposed at the inlet side and the outlet side of temper rolling, and at the downstream side of the nozzles, the inlet-side forced drying device 227 and the blast chamber 205 are further disposed.

In this embodiment, so-called wet temper rolling is performed in which temper rolling is performed while water is being supplied to a steel sheet and rolling rolls in temper rolling. The water supplied onto the steel sheet has an effect of washing out foreign materials such as abraded powders generated in temper rolling, and hence an independent washing device is not necessary before the steel sheet passes through the blast chamber 205. Accordingly, moisture adhering to the steel sheet may only be evaporated by the inlet-side forced drying device 227 disposed at the upstream side of the treatment for forming the surface roughness.

When the configuration as described above is formed, the plating step, the temper rolling for adjusting the mechanical properties of the material, and the blast chamber 205 in which appropriate surface roughness is formed can be disposed on the same line, and hence significant improvement in productivity can be achieved as compared to the batch type surface treatment apparatus shown in FIG. 21.

Figure 23:
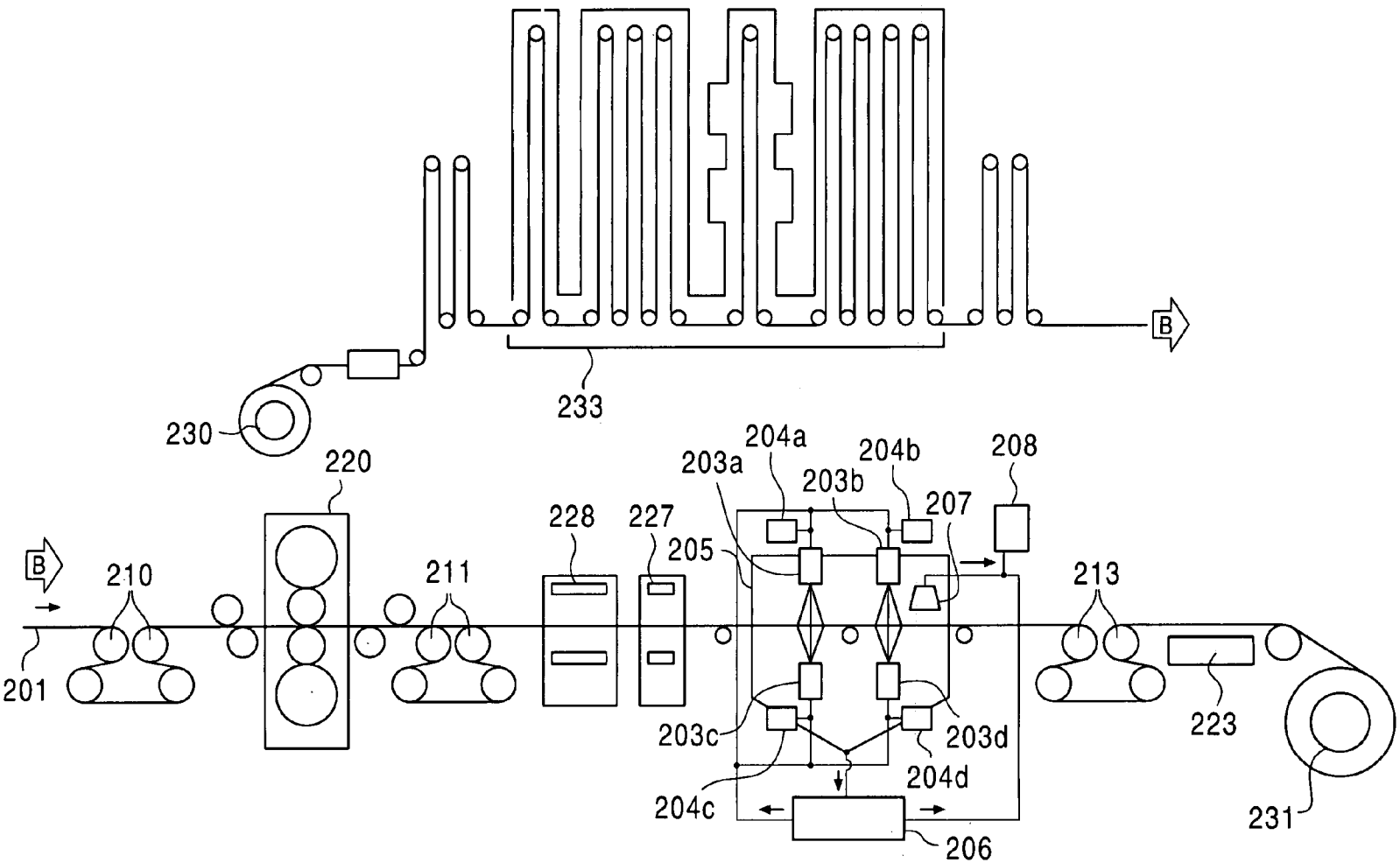
FIG. 23 is a schematic view showing a surface treatment apparatus for a metal sheet, according to embodiment 3-6.

FIG. 23 is a view showing an example of embodiment 3-6. In this example, the configuration is shown in which the temper rolling apparatus 220 is disposed at the downstream side of the annealing furnace 233 of a continuous annealing line, and the inlet-side washing device 228, the inlet-side forced drying device 227, and the blast chamber 205 are continuously disposed at the downstream side of the temper rolling apparatus 220. In the continuous annealing line, a cold-rolled steel sheet is charged to the payoff reel 230, and recrystallization annealing is performed in the annealing furnace 233.

In a general continuous annealing line, after temper rolling is performed by the temper rolling apparatus 220, the steel sheet is coated with antirust oil and is coiled around the tension reel 231. On the other hand, in the embodiment shown in FIG. 23, at the downstream side of the temper rolling apparatus 220, the inlet-side washing device 228, the inlet-side forced drying device 227, and the blast chamber 205 are continuously disposed.

As a temper rolling apparatus disposed in a general continuous annealing line, dry temper rolling performed under dry conditions and wet temper rolling performed under wet conditions may be mentioned, and in FIG. 23, dry temper rolling is shown. In this case, foreign materials such as abraded powders generated in temper rolling remain on the steel sheet, and hence the steel sheet is preferably washed by the inlet-side washing device 228 beforehand. Accordingly, at the downstream side thereof, the forced drying device 222 is disposed for evaporating moisture adhering to the steel sheet, and in the blast chamber 205, the surface roughness of the steel sheet is adjusted.

When the configuration as described above is formed, the annealing step, the temper rolling for adjusting the mechanical properties of the material, and the blast chamber 205 in which appropriate surface roughness is formed can be disposed on the same line, and hence significant improvement in productivity can be achieved as compared to the batch type surface treatment apparatus shown in FIG. 21.

Figure 24:
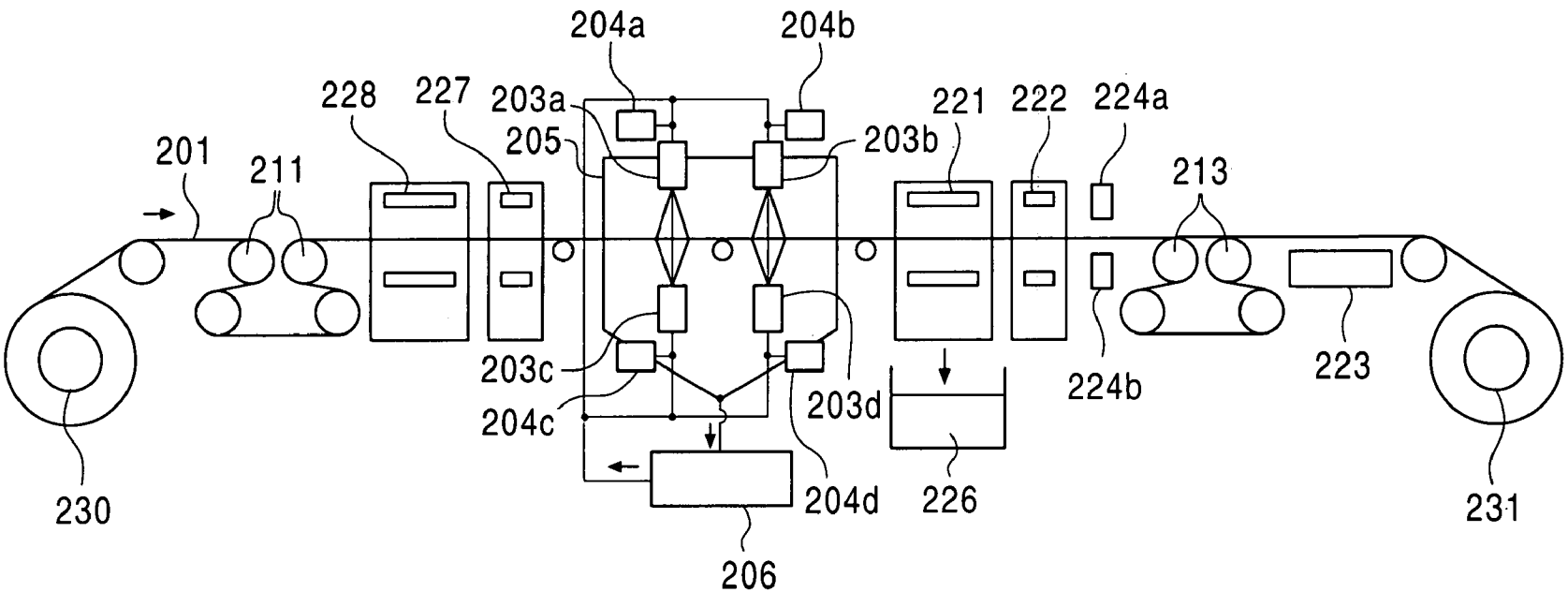
FIG. 24 is a schematic view showing a surface treatment apparatus for a metal sheet, according to embodiment 3-7.

FIG. 24 is a view showing an example of embodiment 3-7. After the steel sheet 201 unwound from the payoff reel 230 is allowed to pass through the bridle roll 211, the surface of the steel sheet is washed by the inlet-side washing device 228, and moisture remaining on the surface described above is removed by evaporation using the inlet-side forced drying device 227. Subsequently, in the blast chamber 205, the surface roughness is adjusted by blasting the solid particles onto the surface. Next, by the outlet-side washing device 221, the solid particles remaining on the surface are washed out.

Furthermore, by the outlet-side drying device 222, remaining moisture is removed by evaporation. Subsequently, by air wiping nozzles 224*a* and 224*b*, solid particles which are not removed by the outlet-side washing device 221 are blown off and are removed from the surface of the steel sheet 201. After inspected on an inspection table, the steel sheet 201 is then coiled around the tension reel 231.

Example 1

As an example of the present invention, the results of the surface roughness of a hot-dip zinc-coated steel sheet adjusted by the apparatus for a metal sheet shown in FIG. 18 will be described, in which the steel sheet had a cold-rolled steel sheet as an underlayer having a thickness of 0.5 to 1.8 mm and a width of 750 to 1,850 mm and was provided with an elongation rate of 0.8% in temper rolling. The elongation rate was provided in temper rolling so as to adjust the material properties, and the temper rolling was performed using bright rolls. In addition, in this example, a zinc-plated steel sheet was used having a plating film primarily composed of a η layer.

The apparatus shown in FIG. 18 was operated at a line speed of up to 100 mpm. The solid particles used in the blast chamber 205 were fine particles made of stainless steel having an average particle diameter of 55 μm. As the blasting device, a centrifugal rotor blasting device was used, and blasting was performed for the steel sheet using an impellor having a diameter of 330 mm and a rotational speed of 3,000 rpm. The blast density of the solid particles was set to 2 kg/m with respect to the steel sheet, and a zinc-plated steel sheet for automobile use having an average roughness Ra of 1.3 μm and a peak count PPI of 400 was manufactured.

In the outlet-side washing device 221, washing was performed by jetting water to the steel sheet at a flow rate of 5 L/min from a jet nozzle. In the outlet-side forced drying device 222, operation was performed using a hot-air drier at a hot-air temperature of 100° C. and a hot-air jet speed of 100 m/s. In addition, at the downstream side of the forced drying device 222, the air wiping nozzles were disposed.

As a result, most of the solid particles remaining on the steel sheet and carried out from the blast chamber 205 were washed out by the washing device, and compared to the case in which the outlet-side washing device 221 was not provided, the unit requirement, that is, the supply amount of solid particles was decreased by 30%. In addition, the amount of solid particles adhering to peripheral mechanical parts was also significantly decreased, and the failure rate of bearings or the like for a deflector roll was remarkably decreased.

Example 2

As an example of the present invention, the results of the surface roughness of a hot-dip zinc-coated steel sheet adjusted by the apparatus for a metal sheet shown in FIG. 21 will be described, in which the steel sheet had a cold-rolled steel sheet as an underlayer having a thickness of 0.5 to 1.8 mm and a width of 750 to 1,850 mm and was provided with an elongation rate of 0.8% in temper rolling. The elongation rate was provided in temper rolling so as to adjust the material properties, and the temper rolling was performed using bright rolls. In addition, in this example, a zinc-plated steel sheet was used having a plating film primarily composed of a η layer.

The apparatus shown in FIG. 21 was operated at a line speed of up to 100 mpm. The solid particles used in the blast chamber 205 were fine particles made of stainless steel having an average particle diameter of 55 μm. As the blasting device, a centrifugal rotor blasting device was used, and blasting was performed for the steel sheet using an impellor having a diameter of 330 mm and a rotational speed of 3,000 rpm. The blast density of the solid particles was set to 2 kg/m with respect to the steel sheet, and a zinc-plated steel sheet for automobile use having an average roughness Ra of 1.3 μm and a peak count PPI of 400 was manufactured.

In the inlet-side washing device 228, washing was performed by jetting water to the steel sheet at a flow rate of 10 L/min from a jet nozzle. In the inlet-side forced drying device 227, operation was performed using a hot-air drier at a hot-air temperature of 100° C. and a hot-air jet speed of 100 m/s. In addition, between the inlet-side washing device 228 and the inlet-side forced drying device 227, air wiping nozzles were disposed, and a drying method was used in which drying was performed after most of the washing water was removed.

As a result, the amount of the solid particles remaining on the steel sheet from the blast chamber 205 and carried out from a blast chamber was remarkably decreased, and compared to the case in which the inlet-side forced drying device 227 and the inlet-side washing device 228 were not provided, the unit requirement, that is, the supply amount of the solid particles was decreased by 60%. In addition, the amount of foreign materials entering the blast chamber was significantly decreased, and the probability of damage done to the steel sheet was decreased by 35%, the damage being caused by foreign materials which were not separated by a separator and which were blasted from the blasting device. Accordingly, a significant effect could be obtained.

Example 3

As an example of the present invention, the results of the surface roughness of a hot-dip zinc-plated steel sheet adjusted by the apparatus for a metal sheet shown in FIG. 24 will be described, in which the steel sheet had a cold-rolled steel sheet as an underlayer having a thickness of 0.5 to 1.8 mm and a width of 750 to 1,850 mm and was provided with an elongation rate of 0.8% in temper rolling. The elongation rate was provided in temper rolling so as to adjust the material properties, and the temper rolling was performed using bright rolls. In addition, in this example, a zinc-plated steel sheet having a plating film primarily composed of a η layer was used.

The apparatus shown in FIG. 24 was operated at a line speed of up to 100 mpm. The solid particles used in the blast chamber 205 were fine particles made of stainless steel having an average particle diameter of 55 μm. As the blasting device, a centrifugal rotor blasting device was used, and blasting was performed for the steel sheet using an impellor having a diameter of 330 mm and a rotational speed of 3,600 rpm. The blast density of the solid particles was set to 5 kg/m with respect to the steel sheet, and a zinc-plated steel sheet for automobile use having an average roughness Ra of 1.3 μm and a peak count PPI of 400 was manufactured.

In the inlet-side washing device 228, washing was performed by jetting water to the steel sheet at a flow rate of 10 L/min from a jet nozzle. In the inlet-side forced drying device 227, operation was performed using a hot-air drier at a hot-air temperature of 100° C. and a hot-air jet speed of 100 m/s. In addition, between the inside-side washing device 228 and the inlet-side forced drying device 227, air wiping nozzles were disposed, and a drying method was used in which drying was performed after most of the washing water was removed.

In addition, in the outlet-side washing device 221 at the downstream side of the surface-roughness formation treatment 205, washing was performed by jetting water to the steel sheet at a flow rate of 5 L/min from a jet nozzle. In the outlet-side forced drying device 222, operation was performed using a hot-air drier at a hot-air temperature of 100° C. and a hot-air jet speed of 100 m/s. In addition, at the downstream side of the outlet-side forced drying device 222, the air wiping nozzles 224*a* and 224*b* were disposed.

As a result, the amount of the solid particles remaining on the steel sheet and carried out from the blast chamber 205 was remarkably decreased, and compared to the case in which the inlet-side forced drying device 227, the inlet-side washing device 228, the outlet-side forced drying device 222, and the outlet-side washing device 221 were not provided, the unit requirement, that is, the supply amount of the solid particles was decreased by 75%. In addition, the amount of foreign materials entering the blast chamber was significantly decreased, and the probability of damage done to the steel sheet was decreased by 35%, the damage being caused by foreign materials which were not separated by a separator and which were blasted from the blasting device. Hence, a significant effect could be obtained. Furthermore, the amount of solid particles adhering to peripheral mechanical parts was also significantly decreased, and the failure rate of bearings or the like for a deflector roll was remarkably decreased.

What is claimed is:

1. A surface treatment apparatus for a metal sheet comprising:

a blasting device for blasting solid particles having an average particle diameter of 300 μm or less onto the metal sheet which is continuously transferred;

a blast chamber in which the blasting device is disposed;

a cleaning means for cleaning a surface of the metal sheet, said cleaning means being provided at the downstream side of the blast chamber, said cleaning means comprising at least one cleaner chamber; and a gas jet device disposed in the at least one cleaner chamber, the gas jet device for blowing-off solid particles towards an upstream side with respect to the transfer direction of the metal sheet.

2. The surface treatment apparatus according to claim 1, wherein said at least one cleaner chamber comprises a plurality of cleaner chambers that are continuously disposed, each of the cleaner chambers having structures partitioned from each other.

3. The surface treatment apparatus according to claim 1, wherein said at least one cleaner chamber has a suction device for sucking solid particles.

4. The surface treatment apparatus according to claim 1, wherein said at least one cleaner chamber has an upper portion height of 500 mm or more at a position closest to the metal sheet.

5. The surface treatment apparatus according to claim 1, wherein said at least one cleaner chamber has an outlet portion having a structure in which the space between an upper portion of the cleaner chamber and the metal sheet is narrowed.

6. The surface treatment apparatus according to claim 5, wherein said at least one cleaner chamber has an upper portion structure inclining downward toward an outlet of the cleaner chamber.

7. The surface treatment apparatus according to claim 1, further comprising a particle removing device provided at an outlet side of the cleaner chamber, the particle removing device having a gas jet device and a suction device disposed to face thereto.

8. The surface treatment apparatus according to claim 1, further comprising a particle removing device provided at an outlet side of the cleaner chamber, the particle removing device comprising a brush roll and a suction device.

9. The surface treatment apparatus according to claim 1, further comprising a particle removing device provided at an outlet side of the cleaner chamber, the particle removing device including an adhesive roll which has an adhesive surface, the adhesive roll being pressed onto the metal sheet.

10. The surface treatment apparatus according to claim 1, further comprising at least two particle removing devices provided at an outlet side of the cleaner chamber, said at least two particle removing devices being selected from the group consisting of:

a particle removing device having a gas jet nozzle and a suction device disposed to face thereto;

a particle removing device comprising a brush roll and a suction hood; and a particle removing device having an adhesive roll which has an adhesive surface and which is pressed onto the metal sheet.

11. The surface treatment apparatus according to claim 1, wherein the cleaning means comprises at least one washing device for washing the surface of the metal sheet.

12. The surface treatment apparatus according to claim 11, further comprising a forced drying device for the metal sheet disposed at the downstream side of the washing device.

13. The surface treatment apparatus according to claim 12, further comprising a gas wiping device for the metal sheet provided at the downstream side of the forced drying device.

14. A surface treatment apparatus for a metal sheet comprising:

a blasting device for blasting solid particles having an average particle diameter of 300 μm or less onto a surface of the metal sheet which is continuously transferred;

a deposits removing device disposed at an inlet side of the blasting device for removing deposits on the surface of the metal sheet; and a deposits measurement device provided at the inlet side of the blasting device for measuring the surface of the metal sheet.

15. The surface treatment apparatus according to claim 14, wherein the deposits removing device comprises at least one device selected from the group consisting of a gas jet device and a suction device.

16. The surface treatment apparatus according to claim 14, wherein the deposits measurement device measures reflected light from the surface of the metal sheet, and determines the amount of the deposits from the measurement result thereof.

* * * * *